US009884484B2

(12) United States Patent
Suzuki

(10) Patent No.: US 9,884,484 B2
(45) Date of Patent: Feb. 6, 2018

(54) PRINTING APPARATUS

(71) Applicant: SEIKO EPSON CORPORATION, Tokyo (JP)

(72) Inventor: Yuto Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/383,060

(22) Filed: Dec. 19, 2016

(65) Prior Publication Data

US 2017/0190182 A1 Jul. 6, 2017

(30) Foreign Application Priority Data

Jan. 5, 2016 (JP) ..... 2016-000401

(51) Int. Cl.
*B41J 2/165* (2006.01)
*B41J 2/17* (2006.01)
*B41J 2/185* (2006.01)

(52) U.S. Cl.
CPC ..... *B41J 2/16517* (2013.01)

(58) Field of Classification Search
CPC ..... B41J 2/16517; B41J 2/1714; B41J 2002/1853
See application file for complete search history.

(56) References Cited

U.S. PATENT DOCUMENTS 6,203,152 B1 * 3/2001 Boleda ..... B41J 29/377 347/102
6,281,910 B1 * 8/2001 Nakano ..... B41J 29/377 347/34
2011/0069115 A1 * 3/2011 Tanabe ..... B41J 2/1714 347/34
2013/0229460 A1 9/2013 Masuda
2016/0031218 A1 * 2/2016 Ishida ..... B41J 2/16585 347/34

FOREIGN PATENT DOCUMENTS

JP 2013-1805539 A 9/2013

* cited by examiner

*Primary Examiner* — Jason Uhlenhake

(74) *Attorney, Agent, or Firm* — Global IP Counselors, LLP

(57) ABSTRACT

In a printing apparatus, ink mist resulting from ink discharge is suctioned by a fan and moves along a flow path (recovery path) formed by alternating ribs in a recovery unit, and the ribs have a width becoming increasingly smaller as a downstream side of the flow path (recovery path) is approached.

12 Claims, 11 Drawing Sheets

PRINTING APPARATUS

BACKGROUND

1. Technical Field

The present invention relates to a printing apparatus that is provided with a recovery device which recovers mist arising from a liquid discharged from a printing unit.

2. Related Art

In the related art, a printing apparatus 100 illustrated in FIG. 17 is known as an example of this type of printing apparatus.

In the printing apparatus 100, a recovery device 130 is disposed in the vicinity of a printing unit 120 and the recovery device 130 suctions mist by means of a fan 131 after the mist is generated from a liquid (ink) that is discharged from the printing unit 120 to a medium PR transported by a transport drum 110. A recovery container 132 of the recovery device 130 accommodates the fan 131 and a filter 133 placed upstream of the fan 131. The recovery device 130 suctions the mist from a suction port 134 formed in the recovery container 132 and recovers the mist by means of the filter 133 by driving the fan 131.

In this recovery device 130, the mist is likely to adhere to the filter 133, and thus the filter 133 is likely to be subjected to clogging and the mist suction force of the fan 131 is likely to decline.

A recovery device in which mist is unlikely to adhere to a filter is conceivable in solving this problem (refer to, for example, JP-A-2013-180539). As an example thereof, a recovery device 230 of a printing apparatus 200 illustrated in FIG. 18 is provided with a suction unit 231 that suctions mist arising from ink discharged from a printing unit 220 to a medium PR transported by a transport drum 210, a recovery unit 232 that recovers the mist, and a hose-shaped outlet portion 233 that allows the suction unit 231 and the recovery unit 232 to communicate with each other. A fan 234 is disposed in the recovery unit 232. A filter 235 is disposed upstream of the fan 234 in the recovery unit 232, and a recovery container 236 to which the outlet portion 233 is connected is disposed upstream of the filter 235. A plurality of vertical walls 237 alternating with each other and an absorbing material 238 absorbing the mist are disposed in the recovery container 236.

As the fan 234 is driven in the recovery device 230, a suction force is generated to the suction unit 231 via the outlet portion 233. Accordingly, the mist between the printing unit 220 and the transport drum 210 is suctioned by the suction unit 231 and is recovered by the recovery unit 232 through the outlet portion 233.

In the printing apparatus 200 that is illustrated in FIG. 18, the recovery container 236 and the vertical walls 237 are placed upstream of the filter 235 along a flow path of the mist, and thus the mist recovered from the outlet portion 233 to the recovery container 236 adheres to the vertical walls 237 and the inner wall of the recovery container 236 before reaching the filter 235. As a result, the mist is unlikely to adhere to the filter 235, and thus a decline in mist recovery performance is more suppressed than in the printing apparatus 100 that is illustrated in FIG. 17.

Because the distances between the adjacent vertical walls 237 are equal to each other as illustrated in FIG. 18, however, the passage cross-sectional areas of the flow paths are equal to each other and the mist has a constant speed during its movement in the recovery container 236. Accordingly, a deviation in terms of mist adhesion amount increases between the plurality of vertical walls 237 and the inner wall of the recovery container 236, and mist adhesion is less likely to occur on the inner wall of the recovery container 236 and the vertical walls 237 where the amount of mist adhesion is large. As a result, the mist is likely to reach the filter 235, and there is room for improvement in this regard.

SUMMARY

An advantage of some aspects of the invention is to provide a printing apparatus that is capable of further suppressing a decline in mist recovery performance.

Hereinafter, means of the invention and operation effects thereof will be described.

A printing apparatus for solving the above problem includes a printing unit performing printing by discharging a liquid to a transported medium, a recovery unit recovering mist arising from the liquid discharged from the printing unit, and an airflow generation source moving the mist into the recovery unit, in which the recovery unit has a recovery path recovering the mist in an inner portion, the recovery path has walls and ribs disposed on the walls, the walls have a first wall and a second wall placed to face the first wall, the ribs have two first ribs disposed toward the second wall from the first wall and having gaps between the second wall and themselves and one second rib disposed toward the first wall from the second wall and having a gap between the first wall and itself, the second rib is disposed between the two first ribs, the first ribs and the second rib have overlapping parts in a direction intersecting with a direction in which the ribs extend, and a gap between the second rib and one of the two first ribs positioned downstream with respect to a direction in which the mist moves is narrower than a gap between the second rib and the other one of the two first ribs positioned upstream with respect to the direction in which the mist moves.

Various types of airflow generation sources are conceivable as the airflow generation source, and the airflow generation source may be a fan performing suctioning from the downstream side of the flow path (recovery path for mist recovery) or may be a pressurization mechanism performing pressurization from the upstream side of the flow path. The placement of the airflow generation source can be performed at any position. In other words, the mist may be caused to flow (move) by the suction force of the fan being transferred to the flow path and an airflow from the upstream side toward the downstream side of the flow path being generated with the fan being placed on the upstream side of the flow path and the fan being connected to the downstream side of the flow path (such as the notches 58*a*) by means of a tube-shaped member. In a case where the airflow generation source is the fan, for example, the driving energy of the airflow generation source is the rotation speed of the fan. When the airflow generation source is the pressurization mechanism, the driving energy is pressure generated per unit area.

The first wall is, for example, the supporting member 56 that is illustrated in FIG. 7. The second wall is, for example, the bottom wall 53*a* that is illustrated in FIG. 7. The first rib is, for example, the drooping rib 57 that is illustrated in FIG. 7. The second rib is, for example, the standing rib 58 that is illustrated in FIG. 7.

A printing apparatus for solving the above problem includes a printing unit performing printing by discharging a liquid to a transported medium, a recovery unit recovering mist arising from the liquid discharged from the printing unit, and an airflow generation source moving the mist into the recovery unit, in which the recovery unit has a recovery path recovering the mist in an inner portion, the recovery path has walls and ribs disposed on the walls, the walls have a first wall and a second wall placed to face the first wall, the ribs have one first rib disposed toward the second wall from the first wall and having a gap between the second wall and itself and one second rib disposed toward the first wall from the second wall and having a gap between the first wall and itself, the first rib and the second rib have overlapping parts in a direction intersecting with a direction in which the ribs extend, the first rib is disposed upstream of the second rib with respect to a direction in which the mist moves, and a gap between a tip of the second rib and the first wall is narrower than a gap between a tip of the first rib and the second wall.

The tips of the ribs are, for example, end portions of the drooping rib 57 and the standing rib 58 that are illustrated in FIG. 7.

In the apparatus described above, it is preferable that the gap between the first rib and the second rib be narrower on the downstream side than on the upstream side in the direction in which the mist moves.

According to this configuration, the passage cross-sectional area of the flow path is smaller on the downstream side than on the upstream side of the mist flow path in the recovery unit, and thus the flow rate of the mist increases from the upstream side toward the downstream side in the flow path. As a result, on the upstream side of the flow path, the mist with a large particle diameter, that is, heavy mist is likely to adhere to the rib, the wall, and the like without turning a curve in the flow path even at the low flow rate of the mist. On the downstream side of the flow path, the mist with a small particle diameter, that is, light mist is likely to adhere to the rib, the wall, and the like without turning a curve in the flow path because of the high flow rate of the mist. The mist is evenly recovered on each of the upstream side and the downstream side of the flow path as described above, and thus a decline in mist recovery performance can be suppressed.

In the apparatus described above, it is preferable that the first wall be a plate-shaped member having a first surface on which the rib is disposed and a second surface on a side opposite to the first surface and the first wall be disposed such that the second surface faces a suction port in the recovery unit suctioning the mist through a gap and is inclined toward an upstream side of the flow path.

According to this configuration, the mist passing through the suction port of the recovery unit is moved in the direction away from the downstream side of the flow path by the first wall forming the flow path and then passes through the flow path formed by the rib and the wall, and thus the mist flow path can be lengthened by the internal space of the recovery unit being effectively used. Accordingly, the amount of mist recovery can be larger than in a case where the flow path is short.

The plate-shaped member mentioned above is, for example, the supporting member 56 that is illustrated in FIG. 7 and is a member whose front and back surfaces have a planar shape alike. The first surface refers to the surface of the supporting member 56 on the bottom wall 53*a* side. The second surface refers to the surface of the supporting member 56 on the suction port 55*a* side.

In the apparatus described above, it is preferable that the recovery unit be connected to a lower part of a support base supporting the medium, a hole communicating with the suction port in the recovery unit suctioning the mist be formed in the support base, the printing unit discharge the liquid toward the support base in a state where a part of the medium is not positioned in the hole during flushing, and driving energy of the airflow generation source during the movement of the mist can be variably controlled.

In the apparatus described above, it is preferable that the airflow generation source be controlled such that the driving energy of the airflow generation source for recovering the mist after printing termination in a case where a share of the liquid in the medium is equal to or higher than a threshold exceeds the driving energy of the airflow generation source for recovering the mist after printing termination in a case where the share is lower than the threshold.

In the apparatus described above, it is preferable that the airflow generation source be driven during the flushing and the printing by the printing unit and the airflow generation source be controlled such that the driving energy at a time when the printing unit performs the flushing in a period following termination of the printing on one surface of the medium and initiation of the printing on the other surface of the medium by the printing unit exceeds the driving energy of the airflow generation source at a time when the printing unit performs the printing on the medium.

In the apparatus described above, it is preferable that the airflow generation source be driven during the flushing and the printing by the printing unit, the printing unit be provided with a nozzle capable of discharging the liquid and a cap capable of covering the nozzle, and the airflow generation source be controlled such that the driving energy at a time when the printing unit performs the flushing after a predetermined period of time in which the printing unit does not discharge the liquid and the nozzle is not covered by the cap exceeds the driving energy of the airflow generation source at a time when the printing unit performs the printing on the medium.

In the apparatus described above, the airflow generation source is a fan and the driving energy is a rotation speed of the fan.

In the apparatus described above, it is preferable that the fan be placed on a downstream side of the flow path.

In the apparatus described above, it is preferable that an absorbing material absorbing the mist be disposed in at least a part of a part constituting the flow path in the recovery unit and a density inside the absorbing material be higher than a density on a surface side of the absorbing material.

Insofar as a printing apparatus for solving the above problem includes a printing unit performing printing by discharging a liquid to a transported medium, a recovery unit recovering mist arising from the liquid discharged from the printing unit, and an airflow generation source moving the mist into the recovery unit, in which the recovery unit has a recovery path along which the mist is moved by an airflow generated by the airflow generation source, and a speed of the mist movement along the recovery path is higher downstream than upstream with respect to a direction of the mist movement, the printing apparatus is not limited to a specific mechanism in solving the above problem.

Hereinafter, the means for solving the above problem and the effects thereof will be described by means of an expression differing from the means for solving the above problem described above. It is a matter of course that the effects described herein apply the same to the means for solving the above problem described above.

The printing apparatus for solving the above problem includes the printing unit performing the printing by discharging the liquid to the transported medium, and a recovery device recovering the mist arising from the liquid discharged from the printing unit, the recovery device has a recovery container in which the mist flows, the fan suctioning the mist into the recovery container, and a filter recovering the mist and disposed upstream of the fan in the flow direction of the mist in the recovery container, the recovery container is provided with a plurality of vertical walls forming the mist flow path by being disposed in an alternating manner, and at least one of the gap between the vertical walls adjacent to each other to form the flow path in the recovery container and the gap between the tip portions of the vertical walls facing each other to form the flow path and a component facing the tip portions becomes gradually narrower toward the downstream side of the flow path that is closer to the fan.

According to this configuration, the passage cross-sectional area of the flow path is smaller on the downstream side than on the upstream side of the mist flow path in the recovery container, and thus the flow rate of the mist increases from the upstream side toward the downstream side in the flow path. As a result, on the upstream side of the flow path, the mist with a large particle diameter, that is, heavy mist is likely to adhere to the vertical wall, the wall of the recovery container, and the like without turning a curve in the flow path even at the low flow rate of the mist. On the downstream side of the flow path, the mist with a small particle diameter, that is, light mist is likely to adhere to the vertical wall, the wall of the recovery container, and the like without turning a curve in the flow path because of the high flow rate of the mist. The mist is evenly recovered on each of the upstream side and the downstream side of the flow path as described above, and thus the amount of the mist adhering to the filter can be reduced and a decline in filter performance is unlikely to occur. Accordingly, a decline in mist recovery performance that is attributable to a decline in the performance of the filter can be suppressed.

In the printing apparatus described above, it is preferable that the supporting member be further provided that faces the mist suction port in the recovery container through a gap and is disposed such that the mist passing through the suction port hits against the supporting member and its flow direction is changed sideways (that is, the upstream side of the flow path), drooping ribs drooping from the supporting member be disposed beneath the supporting member, standing ribs standing toward the supporting member be disposed at parts of the recovery container facing the supporting member from the side opposite to the suction port, and the plurality of vertical walls be configured by the drooping ribs and the standing ribs being disposed in an alternating manner.

According to this configuration, the mist passing through the suction port of the recovery container is moved in the direction away from the fan by the supporting member without moving at the shortest distance toward the fan (filter), and then reaches the filter through the flow path formed by the drooping ribs and the standing ribs. Accordingly, the mist flow path can be lengthened by the internal space of the recovery container being effectively used.

In the printing apparatus described above, it is preferable that an absorbing material absorbing the mist be disposed in at least a part of a part constituting the flow path in the recovery container and a density inside the absorbing material be higher than a density on a surface side of the absorbing material.

According to this configuration, the absorbing material facilitates the recovery of the mist in the recovery container upstream of the filter in the mist flow path. In addition, the mist adhering to the surface of the absorbing material is likely to permeate the absorbing material because of a change in the density of the absorbing material. Accordingly, ink pool formation in the surface of the absorbing material can be suppressed.

In the printing apparatus described above, it is preferable that the recovery container be connected to a lower part of a support base supporting the medium, a hole communicating with the suction port in the recovery container suctioning the mist be formed in the support base, the printing unit discharge the liquid toward the support base in a state where the medium is not transported onto the support base during flushing, and the rotation speed of the fan during the suctioning of the mist can be variably controlled.

It is a matter of course that the flushing may be performed in a state where a part of the medium is not at a position covering the hole in the support base. In addition, it is a matter of course that the rotation speed of the fan can be variably controlled in a state where a part of the medium is not at a position covering the hole in the support base.

According to this configuration, the mist suction force can be changed by the rotation speed of the fan being variably controlled. Accordingly, the mist suction force (fan rotation speed) is appropriately set in accordance with, for example, the amount of the mist afloat between the support base and the printing unit, and then mist adhesion to a part of the support base supporting the medium is unlikely to occur.

In the printing apparatus described above, it is preferable that the fan be driven during the flushing and the printing by the printing unit, the printing unit be provided with a nozzle capable of discharging the liquid and a cap capable of covering the nozzle, and the fan be controlled such that the rotation speed at a time when the printing unit performs the flushing after a predetermined period of time in which the printing unit does not discharge the liquid and the nozzle is not covered by the cap is higher than the rotation speed of the fan at a time when the printing unit performs the printing on the medium.

In a case where the nozzle is not covered by the cap for a long period of time and the liquid in the nozzle is likely to be thickened, it is preferable that the amount of liquid discharge during the execution of the flushing by the printing unit exceed the amount of liquid discharge during the execution of the flushing in a state preceding the thickening of the liquid. However, an increase in the liquid discharge amount leads to an increase in the amount of the mist afloat between the printing unit and the support base.

According to this configuration, the mist suction force is increased by the rotation speed of the fan being increased in a case where the liquid discharge amount during the execution of the flushing by the printing unit is large, and thus the mist afloat between the printing unit and the support base is likely to be suctioned into the recovery container. Accordingly, mist adhesion to the part of the support base supporting the medium can be suppressed.

In the printing apparatus described above, it is preferable that the fan be driven during the flushing and the printing by the printing unit and the fan be controlled such that the rotation speed at a time when the printing unit performs the flushing in a period following termination of the printing on one surface of the medium and initiation of the printing on the other surface of the medium by the printing unit is higher than the rotation speed of the fan at a time when the printing unit performs the printing on the medium.

As is already known, the length of time that is required for so-called switchback in a case where duplex printing is performed on the medium by the printing unit, in which printing on one surface of the medium is terminated and then the medium is transported onto the support base with the medium reversed to the other surface, exceeds the length of time taken for the next medium to be transported onto the support base after the printing on a single surface of the medium by the printing unit is terminated. The printing unit executes the flushing during the switchback in some cases.

A certain period of time is required for an effect in the form of the suctioning of the mist into the recovery container being further facilitated by means of an increase in the rotation speed of the fan to be achieved. Accordingly, the printing unit is not capable of achieving the effect in the form of the suctioning of the mist into the recovery container being further facilitated to a sufficient extent, even if the rotation speed of the fan is increased, within a short period of time such as the length of time taken for the next medium to be transported onto the support base after the printing on the single surface of the medium is terminated.

According to this configuration, the rotation speed of the fan is increased when the printing on the medium is not performed for a long period of time, examples of which include the switchback during execution of a printing job, in this regard. Accordingly, the effect in the form of the suctioning of the mist afloat between the printing unit and the support base into the recovery container being further facilitated can be achieved and mist adhesion to the part of the support base supporting the medium can be suppressed.

In the printing apparatus described above, it is preferable that the fan be controlled such that the rotation speed of the fan for recovering the mist after printing termination in a case where a printing ratio is equal to or higher than a threshold is higher than the rotation speed of the fan for recovering the mist after printing termination in a case where the printing ratio is lower than the threshold.

The total amount of the liquid that the printing unit discharges to the medium when the printing ratio is high exceeds the total amount of the liquid that the printing unit discharges to the medium when the printing ratio is low, and thus the amount of the mist afloat between the printing unit and the support base increases after the printing termination.

According to this configuration, the rotation speed of the fan for suctioning the mist after the printing termination is increased in the case of a high printing ratio in this regard, and thus the mist afloat between the printing unit and the support base is likely to be suctioned into the recovery container. Accordingly, mist adhesion to the part of the support base supporting the medium can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, first and second embodiments of a printing apparatus will be described with reference to accompanying drawings. In each of the embodiments, the printing apparatus is an ink jet printer that forms a character or an image on a sheet by discharging ink as an example of a liquid to the sheet as an example of a medium.

First Embodiment

Figure 1:
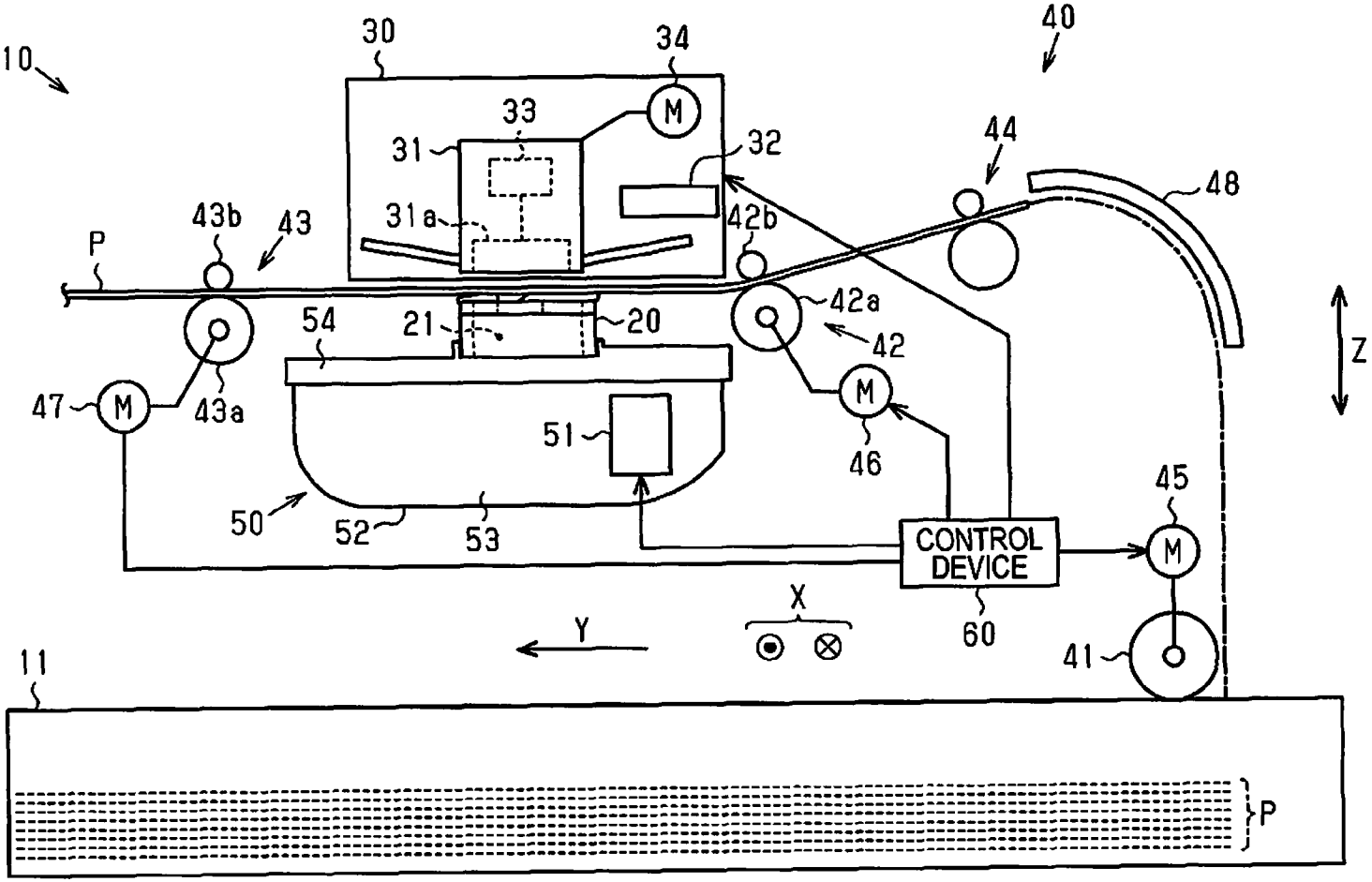
FIG. 1 is a schematic front view of a first embodiment of a printing apparatus.

As illustrated in FIG. 1, a printing apparatus 10 is provided with a sheet cassette 11 that is capable of accommodating stacked sheets P, a support base 20 that supports the sheet P, a printing unit 30 that performs printing by discharging the ink to the sheet P transported onto the support base 20, and a transport unit 40 that transports the sheet P onto the support base 20. In addition, the printing apparatus 10 is provided with a recovery device 50 that recovers mist arising from the ink discharged from the printing unit 30 and a control device 60 that controls the printing unit 30, the transport unit 40, and the recovery device 50. In the following description, the width direction of the sheet P will be defined as a "width direction X" and a direction in which the sheet P is transported will be defined as a "transport direction Y". The width direction X, which is an example of directions intersecting with the transport direction Y, is orthogonal to the transport direction Y.

The printing unit 30 is provided with a discharge head 31 that has multiple nozzles 31*a* which are capable of discharging the ink to the sheet P passing on the support base 20 and a cap 32 that is capable of covering each of the nozzles 31*a* in order to prevent the multiple nozzles 31*a* from drying. The discharge head 31, which is placed at a position that faces the support base 20 through a gap above the support base 20, is a so-called line head that is capable of simultaneously discharging the ink across the width direction X. The discharge head 31 executes so-called flushing, which is forced ink discharge from the nozzle 31*a* at a time when the ink at the nozzle 31*a* has dried and hardened or the viscosity of the ink has increased. The discharge head 31 is provided with piezoelectric elements 33 that discharge the ink from the nozzles 31*a*. The piezoelectric element 33 is disposed for each of the nozzles 31*a*.

The printing unit 30 is also provided with a head moving motor 34 that moves the discharge head 31 between a printing position and a withdrawal position, the printing position being a position of the discharge head 31 where the printing is performed on the sheet P and the withdrawal position being a position where the discharge head 31 is withdrawn from the printing position and the cap 32 is mounted on the nozzle 31*a*.

The support base 20 is a metallic base (such as an aluminum base). The support base 20 has an internal space 21, through which the ink discharged from the nozzle 31*a* as a result of the flushing and the mist arising from the ink are capable of passing. The recovery device 50 is disposed below the support base 20. As a fan 51 of the recovery device 50 is driven, the mist afloat between the printing unit 30 and the support base 20 is recovered via the internal space 21 of the support base 20. The fan 51 according to the present embodiment is an axial fan. The fan 51 may also be another type of fan such as a centrifugal fan.

The transport unit 40 is provided with a pickup roller 41 that sends the uppermost one of the sheets P in the sheet cassette 11, a transport roller pair 42 that transports the sheet P sent by the pickup roller 41 toward the support base 20, and a sheet discharge roller pair 43 that discharges the sheet P after the passage of the sheet P on the support base 20. In addition, the transport unit 40 is provided with a relay roller pair 44 that is disposed in the middle of a transport path of the pickup roller 41 and the transport roller pair 42 (one-dot chain line) and transports the sheet P to the transport roller pair 42.

The pickup roller 41 is rotated by a pickup motor 45 with the width direction X being its axial direction. The transport roller pair 42 is provided with a driving roller 42*a* that is rotated by a transport motor 46 with the width direction X being its axial direction and a driven roller 42*b* that is driven to rotate with the width direction X being its axial direction. As illustrated in FIG. 1, the driven roller 42*b* is positioned above the driving roller 42*a* and downstream of the driving roller 42*a* in the transport direction Y. As a result, the sheet P is pressed on the support base 20. The sheet discharge roller pair 43 is provided with a driving roller 43*a* that is rotated by a sheet discharge motor 47 with the width direction X being its axial direction and a driven roller 43*b* that is driven to rotate with the width direction X being its axial direction.

Figure 2:
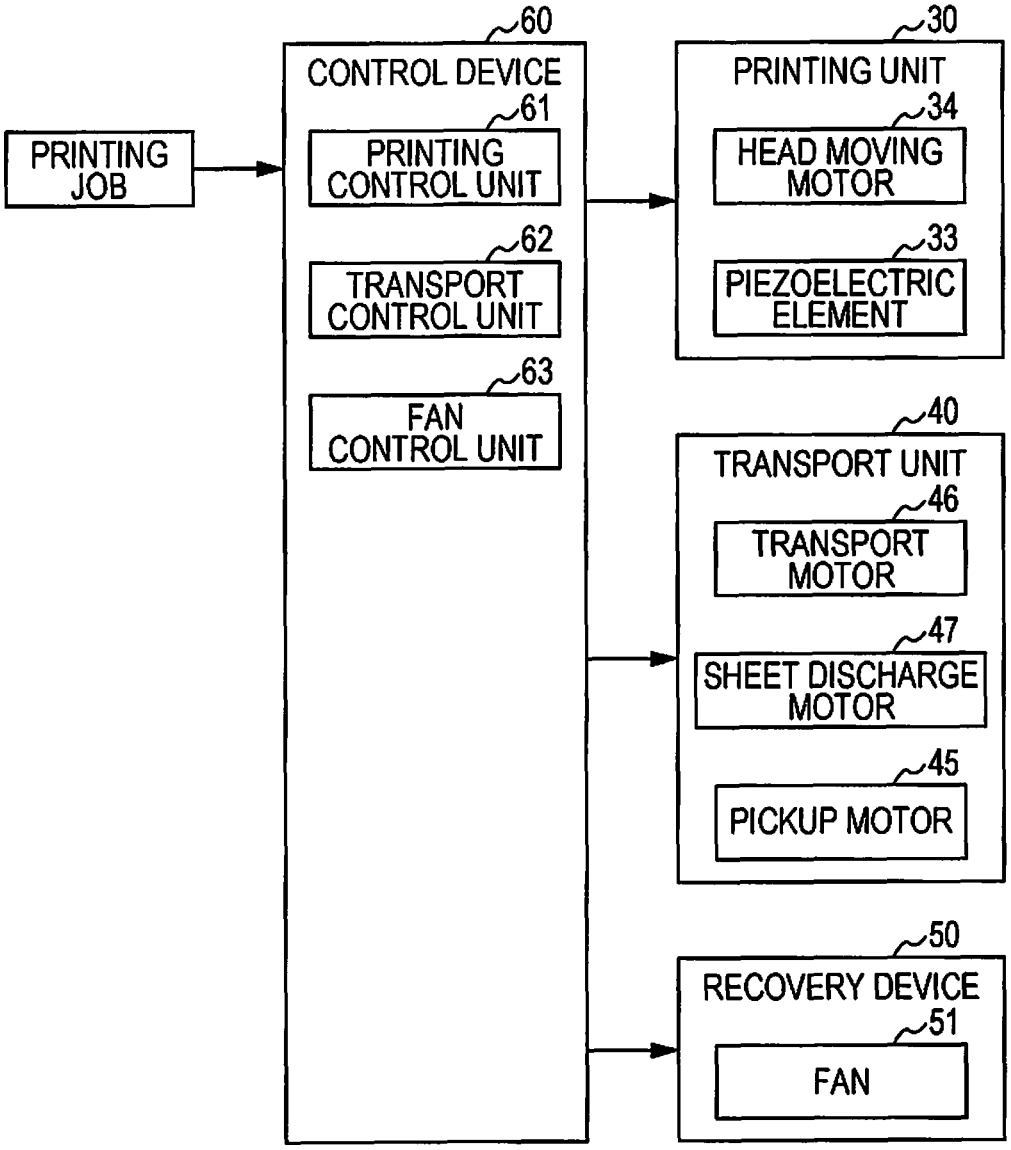
FIG. 2 is a block diagram illustrating an electrical configuration of the printing apparatus.

As illustrated in FIG. 2, the control device 60 is provided with a printing control unit 61 that controls the printing unit 30, a transport control unit 62 that controls the transport unit 40, and a fan control unit 63 that controls the fan 51 of the recovery device 50. A printing job is transmitted to the control device 60 from an external device (such as a personal computer). Based on the printing job, the control device 60 controls the piezoelectric element 33 and the head moving motor 34 by means of the printing control unit 61, controls the pickup motor 45, the transport motor 46, and the sheet discharge motor 47 by means of the transport control unit 62, and controls the fan 51 by means of the fan control unit 63. The fan control unit 63 controls the fan 51 by means of, for example, pulse width modulation (PWM) control.

According to the above-described configuration of the printing apparatus 10 that is illustrated in FIGS. 1 and 2, the sheet P in the sheet cassette 11 is sent by the pickup roller 41, is transported toward the relay roller pair 44 by a guide unit 48 disposed in the middle of the transport path, and is transported onto the support base 20 by the transport roller pair 42. The printing on the sheet P on the support base 20 is performed by the ink being discharged from the discharge head 31. After the printing is performed, the sheet discharge roller pair 43 transports the sheet P downstream in the transport direction Y from the support base 20.

Configurations of the discharge head 31 and the support base 20 will be described in detail with reference to FIGS. 3 to 5.

Figure 3:
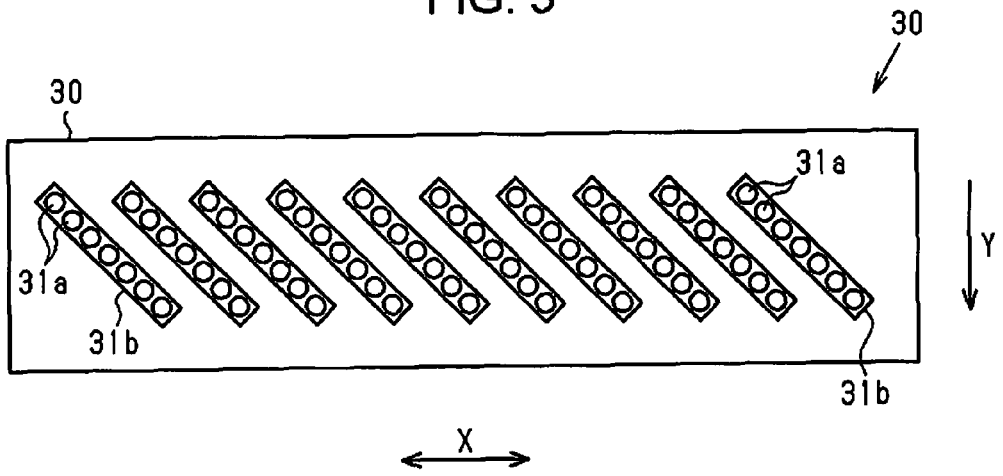
FIG. 3 is a schematic plan view of a discharge head.

As illustrated in FIG. 3, nozzle columns 31*b*, each of which is divided into the plurality of nozzles 31*a*, are formed on a surface of the discharge head 31 that faces the support base 20 (refer to FIG. 1). The nozzle columns 31*b* extend in a direction intersecting with the transport direction Y (in a direction diagonally intersecting with the transport direction Y in FIG. 3). The nozzle columns 31*b* according to the present embodiment extend to one side in the width direction X (right side in the drawing) downstream in the transport direction Y. The nozzle columns 31*b* are parallel to one another and are arranged in the width direction X. Parts of the nozzle columns 31*b* that are adjacent to each other in the width direction X overlap with each other in the transport direction Y.

Figure 4:
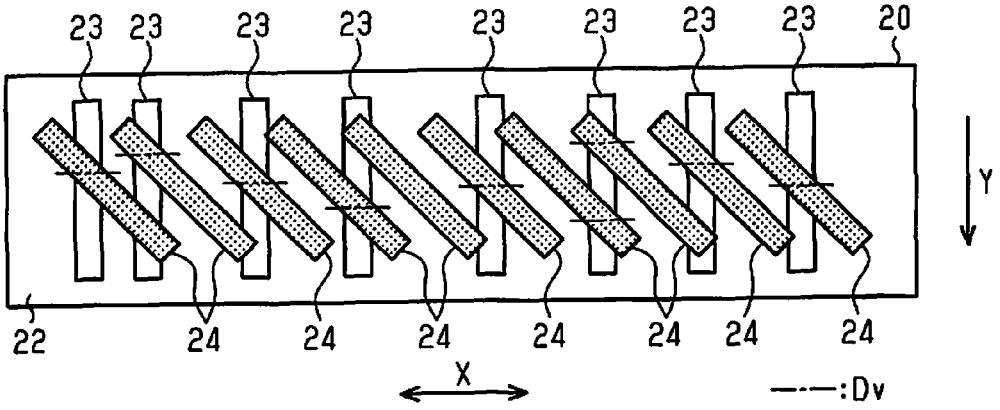
FIG. 4 is a schematic plan view of a support base.

As illustrated in FIG. 4, a plurality of ribs 23 for supporting the sheet P and a plurality of discarding portions 24, which allow the passage of the ink discharged from the discharge head 31 during the flushing into the internal space 21 (refer to FIG. 1), are disposed in a supporting portion 22 of the support base 20 that supports the sheet P (refer to FIG. 1). The plurality of discarding portions 24 are illustrated by hatching in the drawing to be clearly distinguished from the plurality of ribs 23.

The plurality of ribs 23 are formed integrally with the supporting portion 22. Each of the plurality of ribs 23 extends along the transport direction Y. Each of the plurality of ribs 23 is subjected to a water-repellent treatment, a treatment for suppressing static electricity generation, and an anti-wear treatment. Fluorine coating is an example of the water-repellent treatment. Chrome plating is an example of the treatment for suppressing static electricity generation and the anti-wear treatment. Because of these treatments, the ink discharged from the discharge head 31 during the flushing and the mist arising from the ink are unlikely to adhere to the plurality of ribs 23. The ink adhering to the parts of the plurality of ribs 23 that are adjacent to the discarding portions 24 flows to the discarding portions 24. By the fan 51 being driven during the flushing, in particular, the ink adhering to the plurality of ribs 23 is suctioned toward the discarding portions 24. In addition, charging of the ink is suppressed since static electricity generation in the plurality of ribs 23 is suppressed. Furthermore, an increase in the distance between the sheet P supported by the ribs 23 and the discharge head 31 is suppressed since wear of the plurality of ribs 23 attributable to the transport of the sheet P is reduced. The plurality of ribs 23 may be attached to the supporting portion 22 after being formed separately from the supporting portion 22 and one or more of the three treatments described above may be omitted. The three treatments described above may be performed at least on parts of the ribs 23 that are brought into contact with the sheet P.

Figure 5:
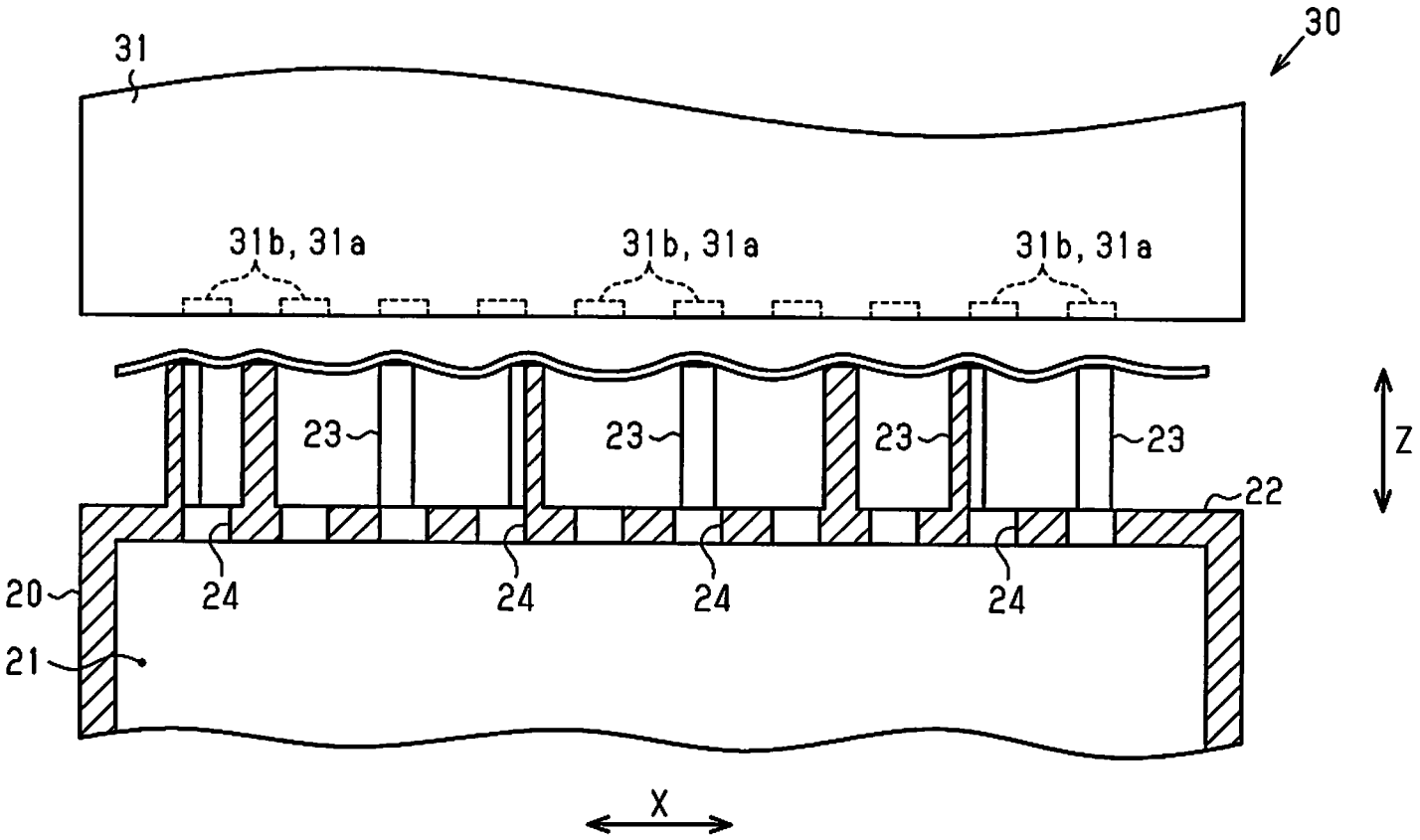
FIG. 5 is a schematic sectional view of the discharge head and the support base.

As illustrated in FIG. 5, the plurality of discarding portions 24 penetrate the supporting portion 22, at positions of the supporting portion 22 that face the respective nozzle columns 31*b*, to communicate with the internal space 21. As illustrated in FIG. 4, the discarding portions 24 are elongated holes that extend to one side in the width direction X (right side in the drawing) downstream in the transport direction Y as is the case with the nozzle columns 31*b*. Accordingly, when the fan 51 (refer to FIG. 1) is driven during the flushing, the ink discharged from the discharge head 31 and the mist arising from the ink pass through the respective discarding portions 24 and are suctioned into the internal space 21 of the support base 20.

The discarding portion 24 extends across the rib 23 in the width direction X. Accordingly, the rib 23 is divided into a plurality of parts in the transport direction Y by intersecting with the discarding portion 24. As illustrated by the one-dot chain lines in FIG. 4, division positions Dv, which are positions resulting from the division in the transport direction Y by the plurality of discarding portions 24, have different positions in the transport direction Y.

Hereinafter, a configuration of the recovery device 50 will be described in detail with reference to FIGS. 6 and 7.

Figure 6:
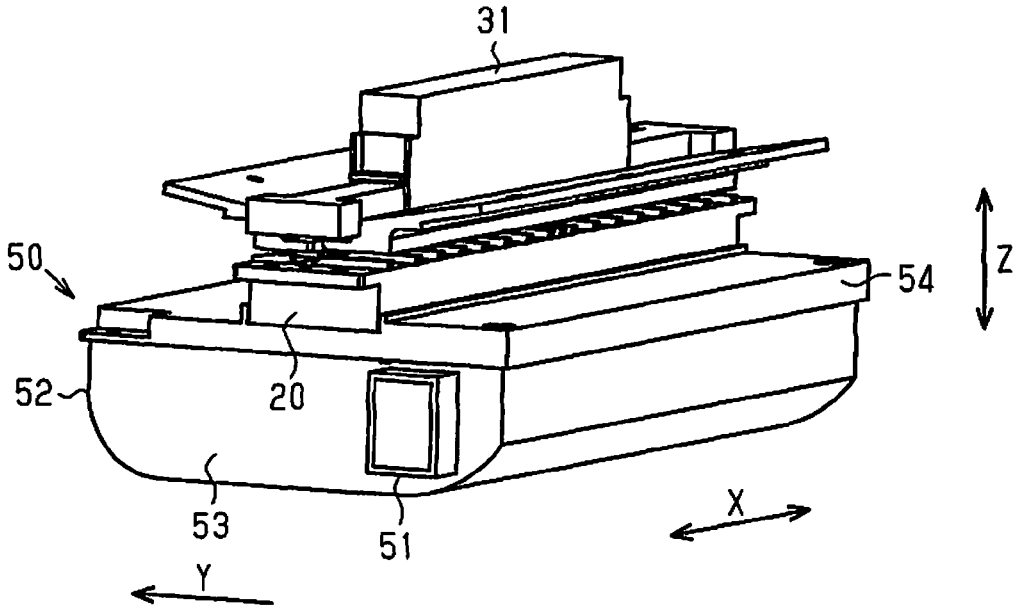
FIG. 6 is a perspective view of the support base, the discharge head, and a recovery device.

As illustrated in FIG. 6, the dimension of the recovery device 50 in the width direction X is almost equal to the dimension of the support base 20 in the width direction X and the dimension of the recovery device 50 in the transport direction Y exceeds the dimension of the support base 20 in the transport direction Y. The support base 20 is placed at the center of the recovery device 50 in the transport direction Y.

The recovery device 50 is provided with a recovery container 52 that accommodates the ink and the mist passing through the support base 20 and causes the mist to flow therein. A box-shaped container main body 53 that has an open upper portion and a cover 54 that covers the opening of the container main body 53 are assembled with each other and constitute the recovery container 52. The fan 51 is attached to an outside wall of the container main body 53 on the upstream side in the transport direction Y and suctions the mist in the recovery container 52.

Figure 7:
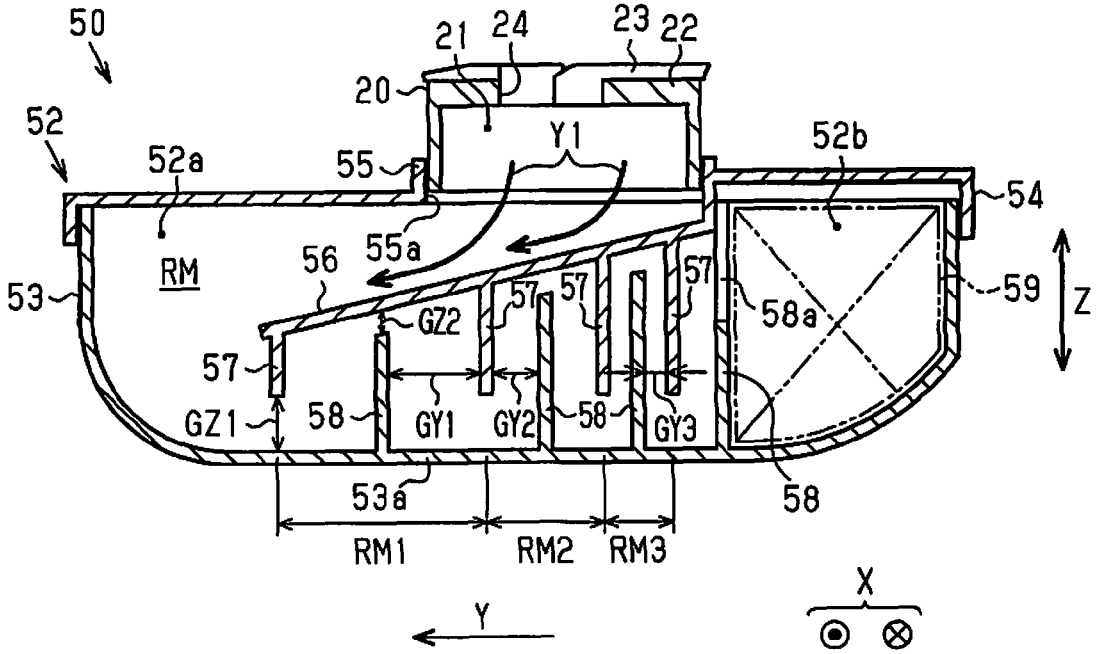
FIG. 7 is a schematic sectional view in which the recovery device and the support base illustrated in FIG. 6 are cut along a plane along a sheet transport direction and a vertical direction.

As illustrated in FIG. 7, an attachment portion 55 is disposed at the center of the cover 54 in the transport direction Y and the support base 20 is attached to the attachment portion 55. In this manner, the recovery container 52 is connected to a lower part of the support base 20. A suction port 55*a* is formed in the attachment portion 55, and the suction port 55*a* allows the internal space 21 of the support base 20 to communicate with the inside of the container main body 53. The dimension of the suction port 55*a* in the width direction X is almost equal to the dimension of the support base 20 in the width direction X and the dimension of the suction port 55*a* in the transport direction Y is almost equal to the dimension of the support base 20 in the transport direction Y. The discarding portion 24 of the support base 20 is an example of a hole that communicates with the mist suction port 55*a* of the recovery container 52.

A supporting member 56 is disposed in an upstream end portion of the attachment portion 55 in the transport direction Y, and the supporting member 56 extends to be inclined downwards toward the downstream side in the transport direction Y. The supporting member 56 faces the suction port 55*a* through a gap below the suction port 55*a* of the recovery container 52 and is disposed such that the ink and the mist passing through the suction port 55*a* hit against the supporting member 56 and their flow direction is changed sideways (to the downstream side in the transport direction Y that is illustrated by the bold arrow Y1 in FIG. 7). The supporting member 56 has a dimension in the width direction X that is almost equal to the dimension of the support base 20 in the width direction X and extends to the downstream side in the transport direction Y more than the support base 20 does. A plurality of drooping ribs 57 are disposed beneath the supporting member 56 with gaps in the transport direction Y and the drooping ribs 57 are an example of a vertical wall drooping toward a bottom wall 53*a* of the container main body 53, which is a part of the container main body 53 facing the supporting member 56 from the side opposite to the suction port 55*a*. The drooping ribs 57 are formed integrally with the supporting member 56. The dimension of the drooping rib 57 in the width direction X is equal to the dimension of the supporting member 56 in the width direction X. The drooping ribs 57 have the same lower end portion positions. Accordingly, gaps GZ1 between the respective lower end portions (tip portions) of the drooping ribs 57 and the bottom wall 53*a* facing the lower end portions (tip portions) are equal to one another. The drooping rib 57 may be fixed to the supporting member 56 after being formed separately from the supporting member 56. In addition, the bottom wall 53*a* of the container main body 53 is an example of components that face the tip portion (lower end portion) of the vertical wall (drooping rib 57).

A plurality of standing ribs 58, which are an example of a vertical wall standing toward the supporting member 56, are disposed on the bottom wall 53*a* of the container main body 53, which is an example of a part of the recovery container 52 facing the supporting member 56 from the side opposite to the suction port 55*a*. The standing ribs 58 are formed integrally with the bottom wall 53*a*. The standing ribs 58 are disposed with gaps such that the standing ribs 58 alternate with the drooping ribs 57 in the transport direction Y. In other words, the drooping ribs 57 and the standing ribs 58 disposed to alternate with each other constitute the plurality of vertical walls. The dimension of the standing rib 58 in the width direction X is equal to the dimension of the supporting member 56 (drooping rib 57) in the width direction X. The dimensions of the standing ribs 58 in a vertical direction Z gradually increase from the downstream side toward the upstream side in the transport direction Y. At this time, gaps GZ2 between respective upper end portions (tip portions) of the standing ribs 58 and the supporting member 56 facing the upper end portions (tip portions) are equal to one another. The gap GZ2 is narrower than the gap GZ1.

One of the plurality of standing ribs 58 that is on the most upstream side in the transport direction Y is in contact with a lower surface of the cover 54. As a result, the inside of the recovery container 52 is partitioned into two spaces, one being a first recovery space 52*a* in which the supporting member 56, the drooping ribs 57, and the standing ribs 58 are disposed and the other one being a second recovery space 52*b* allowing the first recovery space 52*a* and the fan 51 (refer to FIG. 6) to communicate with each other. A filter 59, which is illustrated by the two-dot chain lines in FIG. 7, is disposed in the second recovery space 52*b*. The filter 59, which recovers the mist in the recovery container 52, is disposed at a position upstream of the fan 51 in the flow direction of the mist in the recovery container 52 and with a gap from the fan 51.

A plurality of notches 58*a* are formed, with gaps in the width direction X, on the standing rib 58 on the most upstream side in the transport direction Y. The notches 58*a* have the shape of a recess that is recessed downward from the upper end portion of the standing rib 58. As a result, the first recovery space 52*a* and the second recovery space 52*b* communicate with each other.

A flow path RM is formed in the first recovery space 52*a* as illustrated in FIG. 7, and the flow path RM is a mist-flowing space partitioned by the supporting member 56, the drooping ribs 57, the bottom wall 53*a* of the container main body 53, and the standing ribs 58. As illustrated by the bold arrow Y1 in FIG. 7, the flow path RM is formed by the supporting member 56 and in a direction away from the fan 51 (refer to FIG. 6) in the transport direction Y, that is, in a direction away from the second recovery space 52*b* in the transport direction Y. The supporting member 56, the drooping ribs 57, the bottom wall 53*a* of the container main body 53, and the standing ribs 58 constitute the flow path RM below the supporting member 56. In this manner, the recovery container 52 is provided with the plurality of vertical walls that form the mist flow path RM by being disposed in an alternating manner. The flow path RM below the supporting member 56 has a passage cross-sectional area gradually decreasing toward the downstream side, which is closer to the fan 51. Specifically, a gap GY2 in the transport direction Y between the second drooping rib 57 from the upstream side of the flow path RM and the second standing rib 58 from the upstream side of the flow path RM is narrower than a gap GY1 in the transport direction Y between the first and second drooping ribs 57 from the upstream side of the flow path RM and the first standing rib 58 from the upstream side of the flow path RM. A gap GY3 in the transport direction Y between the third and fourth drooping ribs 57 from the upstream side of the flow path RM and the third standing rib 58 from the upstream side of the flow path RM is narrower than the gap GY2. In this manner, the gaps GY1 to GY3 between the drooping ribs 57 and the standing ribs 58 become gradually narrower toward the downstream side in the flow path RM, which is closer to the fan 51.

In the following description, the flow path RM that has the passage cross-sectional area which the gap GY1 forms will be defined as an "upstream region RM1", the flow path RM that has the passage cross-sectional area which the gap GY2 forms will be defined as a "midstream region RM2", and the flow path RM that has the passage cross-sectional area which the gap GY3 forms will be defined as a "downstream region RM3".

Figure 8:
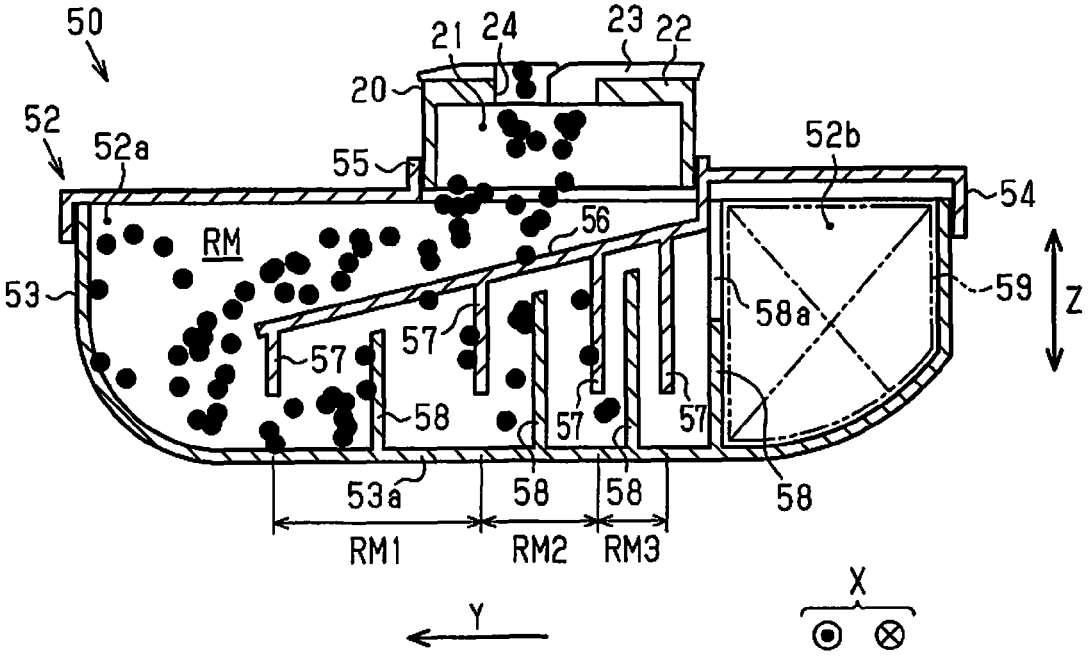
FIG. 8 is a schematic sectional view of the recovery device and the support base for showing an operation.
Figure 9:
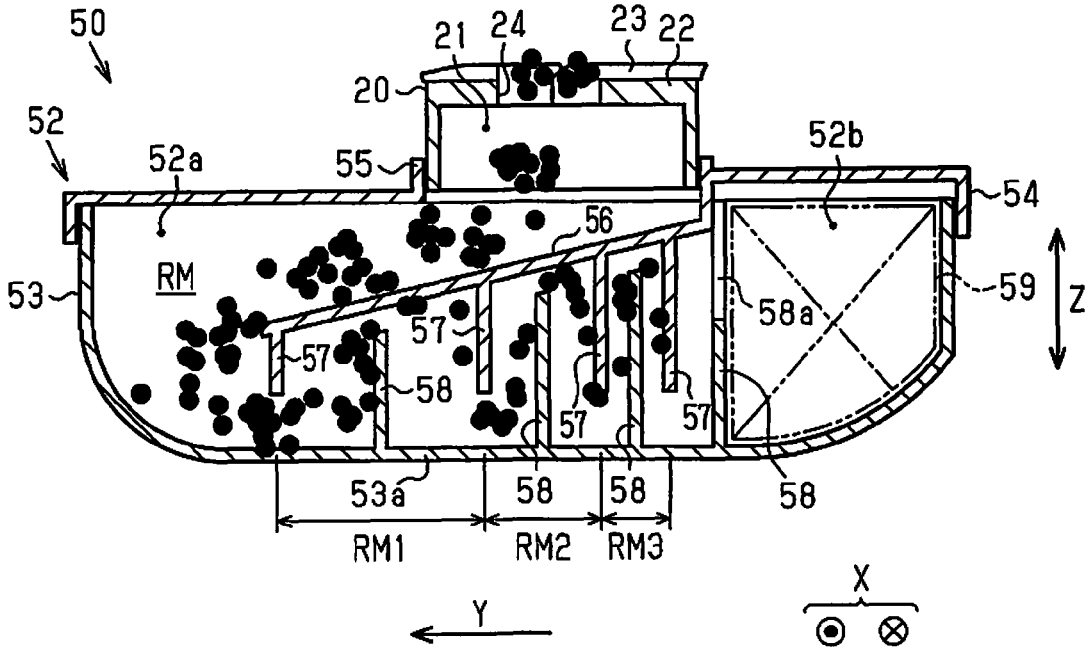
FIG. 9 is a schematic sectional view of the recovery device and the support base for showing an operation.

An operation of the printing apparatus 10 will be described with reference to FIGS. 8 and 9. FIG. 8 shows a simulation result illustrating how mist (black circles) with a large particle diameter flows through the flow path RM and FIG. 9 shows a simulation result illustrating how mist (black circles) with a small particle diameter flows through the flow path RM. The rotation speeds of the fan 51 (FIG. 6) in these simulations are equal to each other.

As illustrated in FIG. 8, the passage cross-sectional area of the upstream region RM1 exceeds the passage cross-sectional areas of the midstream region RM2 and the downstream region RM3, and thus the flow rate of the mist in the upstream region RM1 is lower than the flow rates of the mist in the midstream region RM2 and the downstream region RM3. However, the large particle diameter of the mist, that is, the large weight of the mist, leads to adhesion of the mist to the bottom wall 53*a* of the container main body 53, the supporting member 56, the standing rib 58, and the drooping rib 57 during the mist turning the curve in the upstream region RM1 that is attributable to the centrifugal force resulting from the turning. Although the flow rate of the mist in the midstream region RM2 is lower than the flow rate of the mist in the downstream region RM3, the large particle diameter of the mist similarly leads to adhesion of the mist to the bottom wall 53*a* of the container main body 53, the supporting member 56, the standing rib 58, and the drooping rib 57 during the mist turning the curve in the midstream region RM2. As illustrated in FIG. 8, the mist with the large particle diameter rarely reaches the downstream region RM3.

Meanwhile, the mist with the small particle diameter moves into the downstream region RM3, with a small amount of the mist adhering to the bottom wall 53*a* of the container main body 53, the supporting member 56, the standing ribs 58, and the drooping ribs 57 as illustrated in FIG. 9, after turning the curves in the upstream region RM1 and the midstream region RM2 in the flow path RM. Since the flow rate of the mist is high in the downstream region RM3, the mist adheres to the standing rib 58 and the drooping rib 57 when turning the curve in the downstream region RM3 in the flow path RM as a result of the centrifugal force attributable to the turning.

Once the flow rate of the mist is controlled by the gaps GY1 to GY3 being regulated as described above, mists with different particle diameters evenly adhere to the upstream region RM1, the midstream region RM2, and the downstream region RM3. Then, a deviation in terms of mist adhesion amount among the upstream region RM1, the midstream region RM2, and the downstream region RM3 is reduced during the recovery of the mist by the recovery device 50.

The following effects can be achieved from the present embodiment.

(1) The gaps GY1 to GY3 between the drooping ribs 57 and the standing ribs 58 that are adjacent to each other to form the mist flow path RM become gradually narrower toward the downstream side of the flow path RM closer to the fan 51, and thus the passage cross-sectional area of the flow path RM decreases from the upstream side toward the downstream side of the flow path RM in the recovery container 52. As a result, the flow rate of the mist increases from the upstream side toward the downstream side of the flow path RM, the mists with the different particle diameters evenly adhere in the flow path RM, and thus the amount of the mist adhering to the filter 59 can be reduced. Accordingly, the performance of the filter 59 is unlikely to decline and a decline in mist recovery performance that is attributable to a decline in the performance of the filter 59 can be suppressed.

(2) The mist recovered by the recovery container 52 hits against the supporting member 56, is moved in the direction away from the fan 51, and then reaches the filter 59 through the flow path RM formed by the drooping ribs 57 and the standing ribs 58. The flow path RM can be lengthened by the internal space of the recovery container 52 being effectively used in this manner. Accordingly, the probability of the mist adhering to the drooping ribs 57 and the like in the middle of the flow path RM increases, and thus the mist becomes less likely to adhere to the filter 59. Accordingly, the filter 59 can be used without having to be replaced for an extended period of time and the service life of the recovery device 50 can be extended.

(3) In the recovery container 52, the supporting member 56 extends to the downstream side in the transport direction Y more than the suction port 55*a* does, and thus the mist passing through the suction port 55*a* is likely to hit against the supporting member 56. Accordingly, the mist is moved in the direction away from the fan 51 after hitting against the supporting member 56, and thus the mist is unlikely to reach the filter 59.

(4) One of the plurality of standing ribs 58 that is on the most downstream side of the flow path RM is in contact with the cover 54 and has the notches 58*a* formed in the upper end portion. Accordingly, the probability of the mist coming into contact with the standing rib 58 increases, and thus the amount of the mist adhering to the filter 59 can be reduced.

(5) Since the plurality of discarding portions 24 are formed on the support base 20, the ink discharged from the discharge head 31 is recovered into the recovery container 52 via the discarding portions 24 during the flushing by the discharge head 31. Accordingly, the discharge head 31 does not have to be moved during the flushing by the discharge head 31 and the length of time taken for the printing job to be terminated after the printing job is initiated can be shortened in a case where, for example, the flushing is executed in the middle of the execution of the printing job.

(6) Even if the sheet P subjected to the printing cockles and droops between the plurality of ribs 23 (refer to FIG. 5), the cockling region does not ride on the plurality of ribs 23 since the plurality of ribs 23 on the support base 20 extend along the transport direction Y. Accordingly, the region of the sheet P other than the cockling region coming into contact with the nozzle column 31*b* of the discharge head 31 can be suppressed during the passage of the sheet P subjected to the printing on the plurality of ribs 23.

(7) Since the respective division positions Dv of the plurality of ribs 23 are at different positions in the transport direction Y, the sheet P is transported in a state where a tip portion of the sheet P in the transport direction Y is in the division positions Dv over the entire width direction X and coming into contact in the transport direction Y with those of the plurality of ribs 23 that are on the downstream side in the transport direction Y is suppressed. Accordingly, curling of the tip portion of the sheet P in the transport direction Y is suppressed, and thus the posture of the sheet P on the plurality of ribs 23 can be stabilized and a decline in printing quality can be suppressed.

Second Embodiment

A printing apparatus 10 according to the second embodiment will be described with reference to FIGS. 10 to 12. The printing apparatus 10 according to the present embodiment differs from the printing apparatus 10 according to the first embodiment in that the rotation speed of the fan 51 (refer to FIG. 1) of the recovery device 50 can be variably controlled. In the following description, components of the printing apparatus 10 to which signs are attached represent the respective components of the printing apparatus 10 illustrated in FIGS. 1 to 7.

The control device 60 drives the fan 51 throughout, for example, a driving period following the termination of the printing job after the printing job is received. In other words, the fan 51 is driven during the flushing and the printing by the printing unit 30. In some cases, the flushing is executed before the initiation of the printing on the sheet P following the reception of the printing job and in the middle of the printing on the sheet P. In some cases, the printing unit 30 discharges the ink toward the support base 20 in a state where the sheet P has yet to be transported onto the support base 20 during the flushing. The driving period mentioned above is a period in which the fan 51 is driven for mist suctioning after the termination of the printing job. This driving period is set in advance through an experiment or the like.

The ink discharged from the multiple nozzles 31*a* during, for example, the flushing is accommodated in the recovery container 52 via the plurality of discarding portions 24 of the support base 20. Since the ribs 23 are divided by the discarding portions 24 intersecting with the ribs 23, it is preferable that the discarding portion 24 have a small width dimension for the sheet P to be stably supported on the ribs 23. However, since the ink (mist) discharged from the nozzles 31*a* is moved toward the support base 20 while spreading in a fan shape, a small width dimension of the discarding portion 24 might result in adhesion to the supporting portion 22 or the rib 23 other than the discarding portion 24. As a result, the sheet P is contaminated due to ink transfer onto the sheet P when the sheet P is transported onto, for example, the ink-adhering rib 23.

An increase in the suction force with which the mist is suctioned by the recovery device 50 is conceivable in view of this problem. Once the suction force is increased, the mist is suctioned into the discarding portion 24, even if the ink (mist) discharged from the nozzle 31*a* spreads in a fan shape, since the suction force generated via the discarding portion 24 by the driving of the fan 51 is large. When a large mist suction force is maintained at all times, that is, when a high rotation speed of the fan 51 is maintained at all times, however, the ink discharged from the nozzle 31*a* during the printing on the sheet P is affected as well. As a result, an image or the like that is printed on the sheet P is disturbed.

Accordingly, it is not preferable that a high rotation speed of the fan 51 be maintained at all times and it is preferable that the rotation speed of the fan 51 be increased in a case where the mist is afloat between the printing unit 30 and the support base 20 and the mist might adhere to the rib 23 and the supporting portion 22, examples of which include a moment during the flushing and a moment following the termination of the printing.

In this regard, the control device 60 variably controls the rotation speed of the fan 51 when the recovery device 50 suctions the mist in a state where the mist is afloat between the discharge head 31 and the support base 20, examples of which include a moment during the flushing and a moment following the termination of the printing job. The fan control unit 63 of the control device 60 changes the rotation speed of the fan 51 by changing the duty ratio of a PWM driving circuit (not illustrated) of the fan 51. The rotation speed of the fan 51 increases as, for example, the duty ratio increases. In a case where the rotation speed of the fan 51 does not have to be variably controlled, the rotation speed of the fan 51 is set to the rotation speed of the fan 51 during the printing on the sheet P (hereinafter, referred to as a "reference rotation speed").

Examples of a case where the rotation speed of the fan 51 is variably controlled include a moment during the flushing preceding the initiation of the printing on the sheet P, a moment in the middle of the execution of duplex printing on the sheet P, and the driving period following the termination of the printing job. Hereinafter, processing for setting the rotation speed of the fan 51 for each of the occasions will be described.

The processing for setting the rotation speed of the fan 51 during the flushing preceding the initiation of the printing on the sheet P will be described first with reference to FIG. 10. This setting processing is repeatedly executed at predetermined time intervals until the elapse of a set period of time after the termination of the previous printing job. The set period of time, which is set in advance through an experiment or the like, is a period of time leading to a determination that the cap 32 needs to be mounted on the nozzle 31*a*. Examples of the set period of time include a period of time starting at the termination of the printing job and ending at the moment immediately preceding the possibility of the printing quality being affected by the drying of the ink and an excessive increase in its viscosity attributable to the exposure of the nozzle 31*a* to air.

The control device 60 determines whether or not a predetermined period of time shorter than the set period of time has elapsed (Step S11). This predetermined period of time, which is set in advance through an experiment or the like, is a period of time during which the exposure of the nozzle 31*a* to the air, the drying of the ink, and an increase in its viscosity are regarded as occurring after the termination of the printing job. Once it is determined that the predetermined period of time has elapsed (Step S11: YES), the control device 60 determines whether or not the set period of time has elapsed (Step S12).

In a case where it is determined that the set period of time has elapsed (Step S12: YES), the control device 60 mounts the cap 32 on the nozzle 31*a* (Step S13). In this case, the control device 60 maintains the rotation speed of the fan 51 at the reference rotation speed (Step S14). The control device 60 temporarily terminates the processing in a case where it is determined that the predetermined period of time has not elapsed (Step S11: NO).

In a case where it is determined that the set period of time has not elapsed (Step S12: NO), the control device 60 determines whether or not the next printing job has been received (Step S15). Once it is determined that the next printing job has not been received (Step S15: NO), the control device 60 returns to the determination of Step S12. Once it is determined that the next printing job has been received (Step S15: YES), the control device 60 determines whether or not a flushing execution period is in progress (Step S16). The flushing execution period is a period starting at the execution of the flushing by the printing unit 30 and ending at the termination of the recovery of the mist afloat between the printing unit 30 and the support base 20 by the recovery device 50. The flushing execution period is set in advance through an experiment or the like.

Once it is determined that the flushing execution period is in progress (Step S16: YES), the control device 60 sets the rotation speed of the fan 51 to a rotation speed higher than the reference rotation speed (Step S17). The rotation speed higher than the reference rotation speed is set in advance through an experiment or the like. The amount of suctioning per unit time of the mist afloat between the printing unit 30 and the support base 20 during the driving of the fan 51 at the rotation speed higher than the reference rotation speed may exceed the amount of suctioning per unit time of the mist afloat between the printing unit 30 and the support base 20 during the driving of the fan 51 at the reference rotation speed. The rotation speed higher than the reference rotation speed can be changed at will. Once it is determined that the flushing execution period is not in progress (Step S16: NO), the control device 60 temporarily terminates the processing.

The processing for setting the rotation speed of the fan 51 in the middle of the execution of the duplex printing on the sheet P will be described below with reference to FIG. 11. This setting processing is repeatedly executed during the printing on the sheet P and is terminated at the termination of the printing on the sheet P. This setting processing is not executed in the case of simplex printing on the sheet P.

The control device 60 determines whether or not to execute the flushing (Step S21). The flushing is executed during so-called switchback, during which the sheet P is transported onto the support base 20 in a state where the sheet P is reversed for the other surface of the sheet P to be directed toward the discharge head 31 after the termination of the printing on one surface of the sheet P. In the case of printing on the plurality of sheets P, the flushing is executed after the printing on a certain number of the sheets P without the flushing being executed for the switchback of each of the sheets P. In a case where the printing according to the printing job is to be performed on the single sheet P, the flushing is executed during the switchback when the ink at the nozzle 31*a* has a high viscosity and the flushing is not executed during the switchback when the ink at the nozzle 31*a* has a low viscosity. For example, the viscosity of the ink to trigger the execution of the flushing is set in advance and the flushing is executed during the switchback when a viscosity higher than the set ink viscosity is anticipated.

Accordingly, the determination of Step S21 is performed based on whether or not a period is in progress in which the switchback during the execution of the flushing is in progress.

Once it is determined that the execution of the flushing is in progress (Step S21: YES), the control device 60 sets the rotation speed of the fan 51 to a rotation speed higher than the reference rotation speed (Step S22). Once it is determined that the execution of the flushing is not in progress (Step S21: NO), the control device 60 maintains the rotation speed of the fan 51 at the reference rotation speed (Step S23). The rotation speed higher than the reference rotation speed may be equal to or different from the rotation speed higher than the reference rotation speed according to the setting processing illustrated in FIG. 10. The rotation speed higher than the reference rotation speed can be changed at will.

The processing for setting the rotation speed of the fan 51 during the driving period following the termination of the printing job will be described below with reference to FIG. 12.

The control device 60 determines whether or not a printing ratio is equal to or higher than a threshold (Step S31). The printing ratio is the share of an image, a character, or the like in the sheet P and is calculated from information on the image, the character, or the like that is included in the printing job. The threshold, which is set in advance through an experiment or the like, is a lower limit value of the printing ratio at which the amount of the mist afloat between the discharge head 31 and the support base 20 is predicted to become excessively large after the termination of the printing job.

Once it is determined that the printing ratio is equal to or higher than the threshold (Step S31: YES), the control device 60 sets the rotation speed of the fan 51 to a rotation speed higher than the reference rotation speed (Step S32). Once it is determined that the printing ratio is lower than the threshold (Step S31: NO), the control device 60 maintains the rotation speed of the fan 51 at the reference rotation speed (Step S33). The rotation speed higher than the reference rotation speed may be equal to or different from the rotation speed higher than the reference rotation speed according to the setting processing illustrated in FIGS. 10 and 11. The rotation speed higher than the reference rotation speed can be changed at will.

The following effects as well as the effects of the first embodiment are achieved from the present embodiment.

(8) If the cap 32 is mounted on the nozzle 31*a* when the next printing job is quickly received after the termination of the printing job, an operation for removing the cap 32 again from the nozzle 31*a* will be included when the printing is performed on the sheet P based on the next printing job, and thus the length of time until the initiation of the printing will increase. Accordingly, it is preferable that the printing on the sheet P based on the next printing job be initiated in a state where the cap 32 is not mounted on the nozzle 31*a*. The length of time during which the nozzle 31*a* is exposed to the air increases at this time, and thus the viscosity of the ink in the nozzle 31*a* increases in some cases. During the flushing preceding the printing initiation, the amount of the ink discharged from the nozzles 31*a* is increased. Accordingly, the amount of the mist afloat between the discharge head 31 and the support base 20 increases and the possibility of adhesion to the ribs 23 of the support base 20 increases.

In the present embodiment, the rotation speed of the fan 51 during the execution of the flushing preceding the initiation of the printing on the sheet P is controlled to become higher than the reference rotation speed in a case where the next printing job is received after the termination of the printing job and before the elapse of the set period of time in this regard. As a result, the mist suction force increases, and thus the mist afloat between the discharge head 31 and the support base 20 can be suctioned in quantity into the recovery container 52. Accordingly, mist adhesion to the plurality of ribs 23 of the support base 20 can be suppressed.

(9) As is already known, the length of time that is required for the switchback when the duplex printing is performed on the sheet P exceeds the length of time taken for the next sheet P to be transported onto the support base 20 after the printing on one surface of the sheet P is terminated. The printing unit 30 executes the flushing during the switchback in some cases.

A certain period of time is required for an effect in the form of the suctioning of the mist into the recovery container 52 being further facilitated by means of an increase in the rotation speed of the fan 51 to be achieved. Accordingly, the printing unit 30 is not capable of achieving the effect in the form of the suctioning of the mist into the recovery container 52 being further facilitated to a sufficient extent, even if the rotation speed of the fan 51 is increased, within a short period of time such as the length of time taken for the next sheet P to be transported onto the support base 20 after the printing on one surface of the sheet P is terminated.

In the present embodiment, the rotation speed of the fan 51 is increased when the printing on the sheet P is not performed for a long period of time, examples of which include the switchback during the duplex printing on the sheet P, in this regard. Accordingly, the effect in the form of the suctioning of the mist afloat between the printing unit 30 and the support base 20 into the recovery container 52 being further facilitated can be achieved and mist adhesion to the plurality of ribs 23 of the support base 20 can be suppressed.

(10) The total amount of the ink that the printing unit 30 discharges to the sheet P when the printing ratio is high exceeds the total amount of the ink that the printing unit 30 discharges to the sheet P when the printing ratio is low, and thus the amount of the mist afloat between the printing unit 30 and the support base 20 increases after the printing termination.

In the present embodiment, the rotation speed of the fan 51 after the printing termination is increased in the case of a high printing ratio in this regard, and thus the mist afloat between the printing unit 30 and the support base 20 is likely to be suctioned into the recovery container 52. Accordingly, mist adhesion to the plurality of ribs 23 of the support base 20 can be suppressed.

Modification Example

Each of the embodiments described above may be modified in the form of another embodiment as follows.

Figure 10:
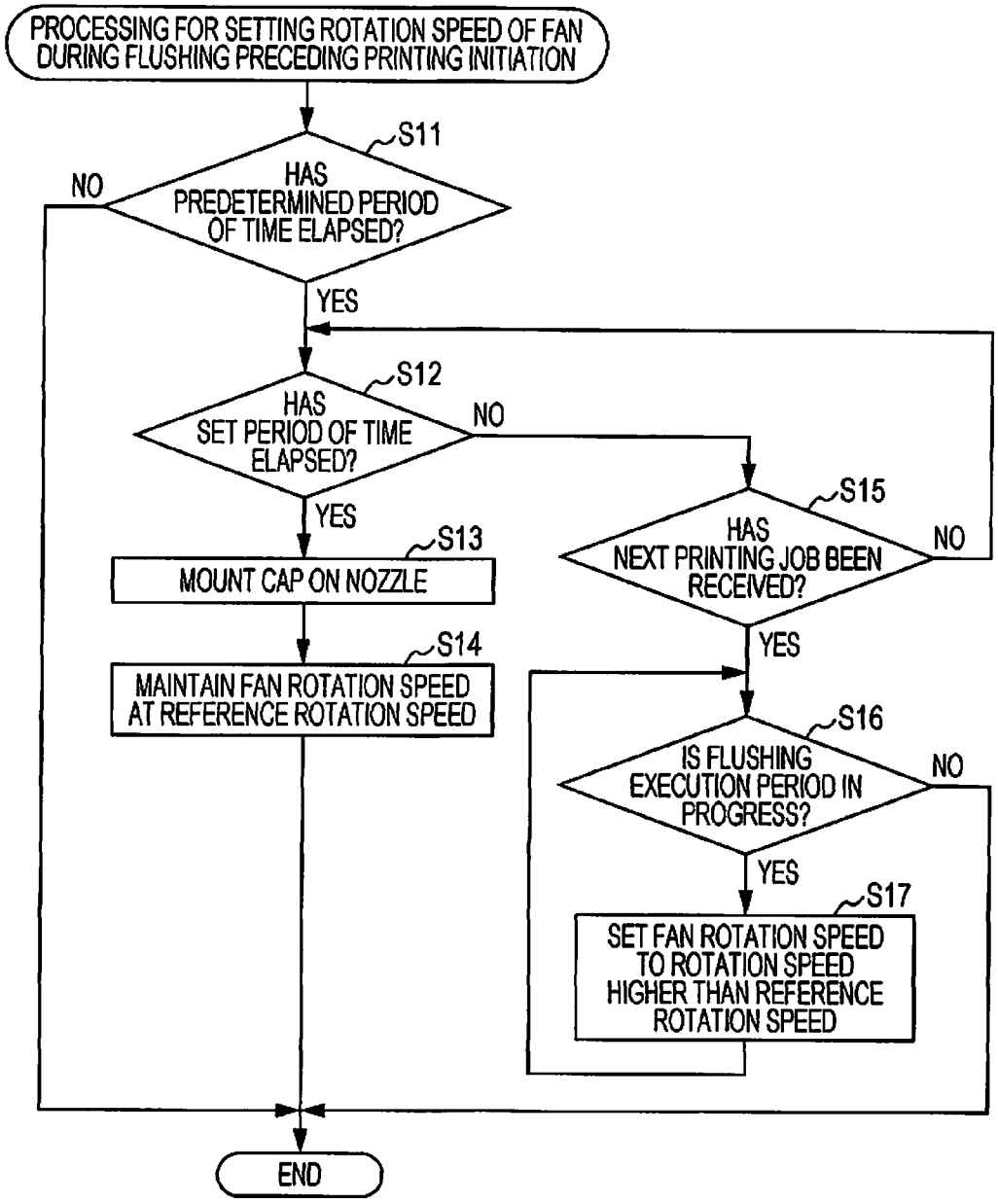
FIG. 10 is a flowchart showing fan rotation speed setting processing at a time of flushing preceding printing initiation with regard to a second embodiment of the printing apparatus.
Figure 11:
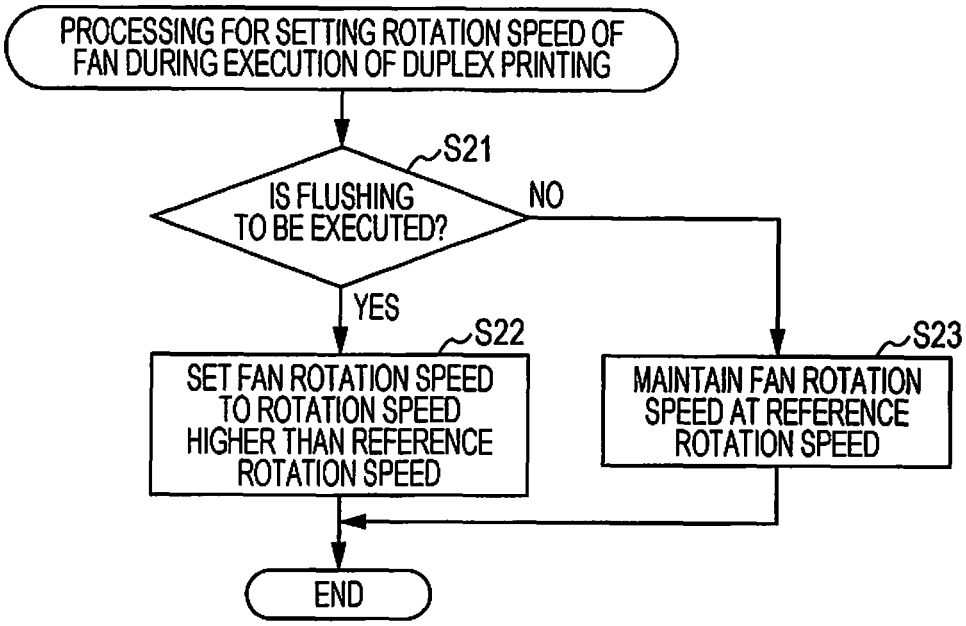
FIG. 11 is a flowchart showing fan rotation speed setting processing at a time of duplex printing execution.
Figure 12:
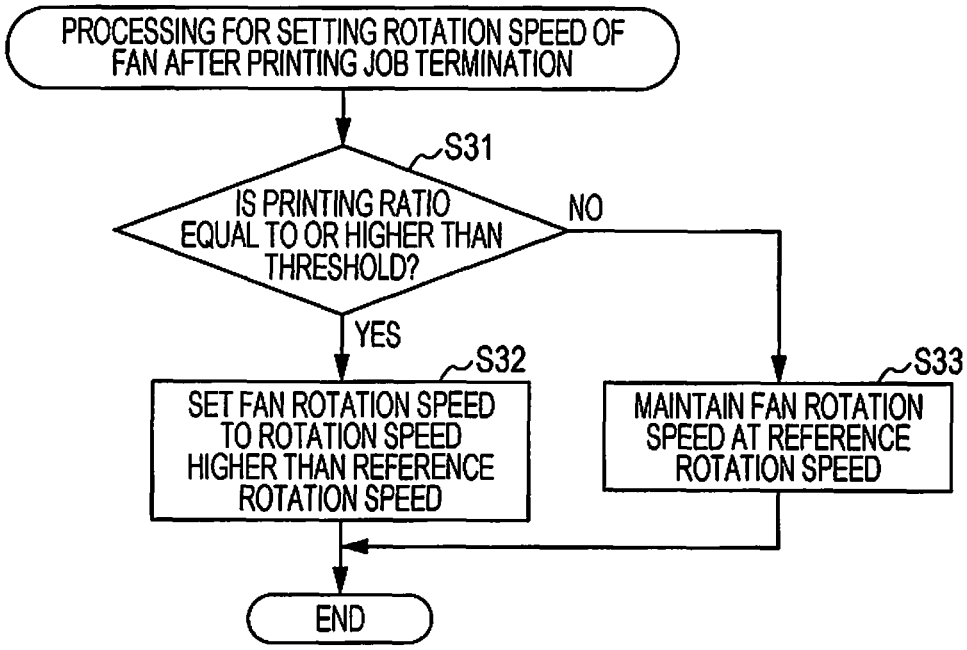
FIG. 12 is a flowchart showing fan rotation speed setting processing following printing job termination.

In the second embodiment, one or more of the setting processing regarding the rotation speed of the fan 51 illustrated in FIGS. 10 to 12 may be omitted. In a case where the entire setting processing regarding the rotation speed of the fan 51 illustrated in FIGS. 10 to 12 is omitted, for example, control may be performed such that the fan 51 has a constant rotation speed (such as the reference rotation speed).

In the second embodiment, the rotation speed of the fan 51 is allowed to be higher than the reference rotation speed in a case where the printing ratio is equal to or higher than the threshold. The driving period may be lengthened instead in that case. Alternatively, the driving period may be lengthened after the rotation speed of the fan 51 is allowed to be higher than the reference rotation speed.

Figure 13:
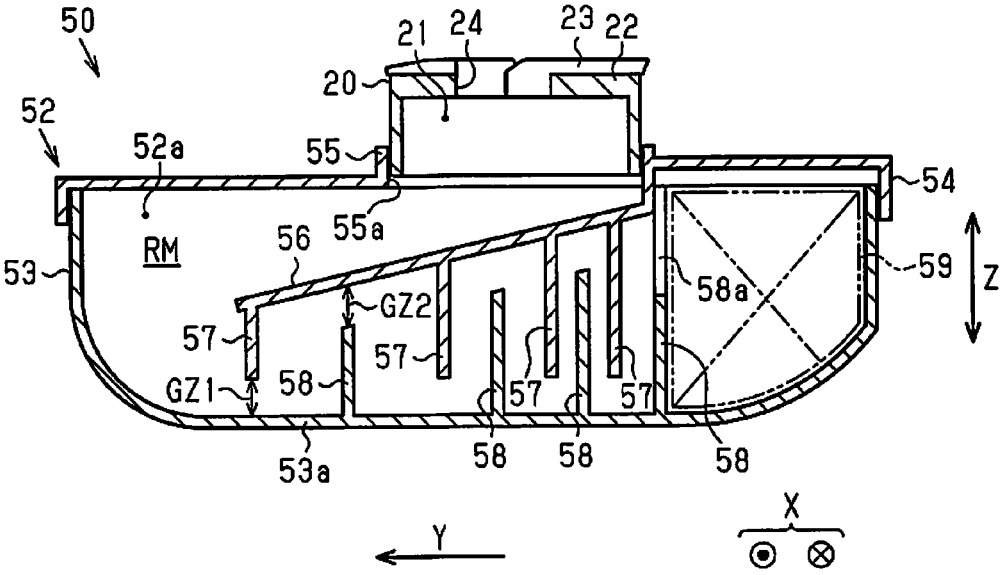
FIG. 13 is a schematic sectional view of a recovery device and a support base of a printing apparatus according to a modification example.

In each of the embodiments, any length can be set as the lengths of the drooping ribs 57 and the standing ribs 58 in the vertical direction Z. For example, the drooping ribs 57 may have a length in the vertical direction Z that exceeds the lengths of the drooping ribs 57 in the vertical direction Z according to each of the embodiments (refer to FIG. 7) as illustrated in FIG. 13. In this case, the gap GZ1 in the vertical direction Z between the lower end portions of the drooping ribs 57 and the bottom wall 53*a* of the recovery container 52 is narrower than the gap GZ1 in the vertical direction Z between the lower end portions of the drooping ribs 57 according to each of the embodiments and the bottom wall 53*a* of the recovery container 52 (refer to FIG. 7). In addition, the lengths of the standing ribs 58 in the vertical direction Z may be exceeded by the lengths of the standing ribs 58 in the vertical direction Z according to each of the embodiments (refer to FIG. 7) as illustrated in FIG. 13. In this case, the gap GZ2 in the vertical direction Z between the upper end portions of the standing ribs 58 and the supporting member 56 is wider than the gap GZ2 in the vertical direction Z between the upper end portions of the standing ribs 58 according to each of the embodiments and the supporting member 56 (refer to FIG. 7). The gap GZ1 and the gap GZ2 are equal to each other in the recovery device 50 that is illustrated in FIG. 13.

Figure 14:
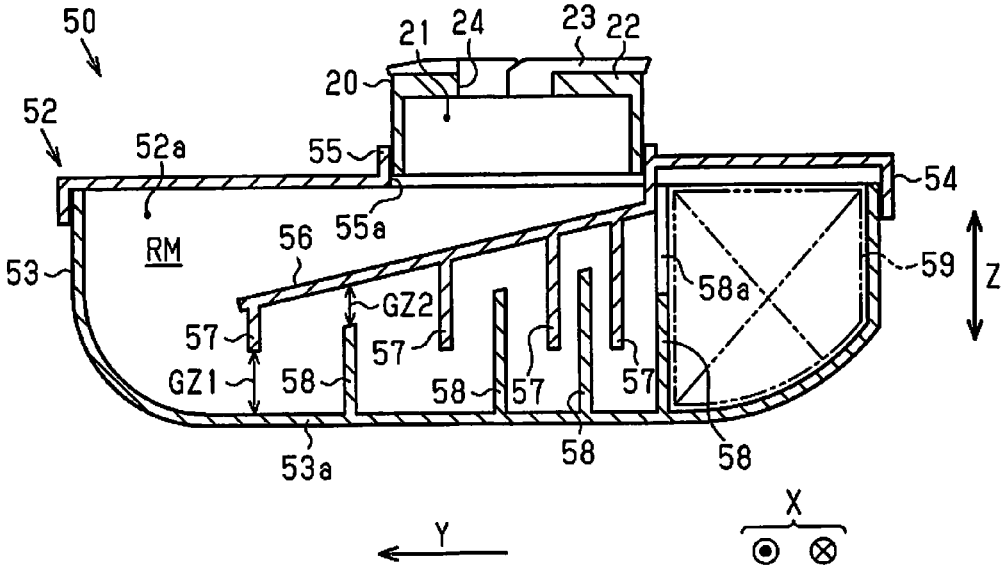
FIG. 14 is a schematic sectional view of a recovery device and a support base of a printing apparatus according to a modification example.

Furthermore, the gap GZ1 in the vertical direction Z between the lower end portions of the drooping ribs 57 and the bottom wall 53*a* of the recovery container 52 and the gap GZ2 in the vertical direction Z between the upper end portions of the standing ribs 58 and the supporting member 56 may differ from each other by the length of the drooping rib 57 in the vertical direction Z being exceeded by the length of the drooping rib 57 in the vertical direction Z illustrated in FIG. 13 as illustrated in FIG. 14. The gap GZ1 is wider than the gap GZ2 in the recovery device 50 that is illustrated in FIG. 14. The length of the drooping rib 57 in the vertical direction Z that is illustrated in FIG. 14 is exceeded by the length of the drooping rib 57 in the vertical direction Z according to each of the embodiments, but the length of the drooping rib 57 in the vertical direction Z that is illustrated in FIG. 14 may be equal to the length of the drooping rib 57 in the vertical direction Z according to each of the embodiments as well.

Although not illustrated herein, the gap GZ1 in the vertical direction Z between the lower end portions of the drooping ribs 57 and the bottom wall 53*a* of the recovery container 52 and the gap GZ2 in the vertical direction Z between the upper end portions of the standing ribs 58 and the supporting member 56 may differ from each other by the length of the standing rib 58 in the vertical direction Z being reduced in the recovery device 50 that is illustrated in FIG. 13. According to these configurations, the flow rate of the mist can be regulated based on a change in the passage cross-sectional area of a part of the mist flow path.

Figure 15:
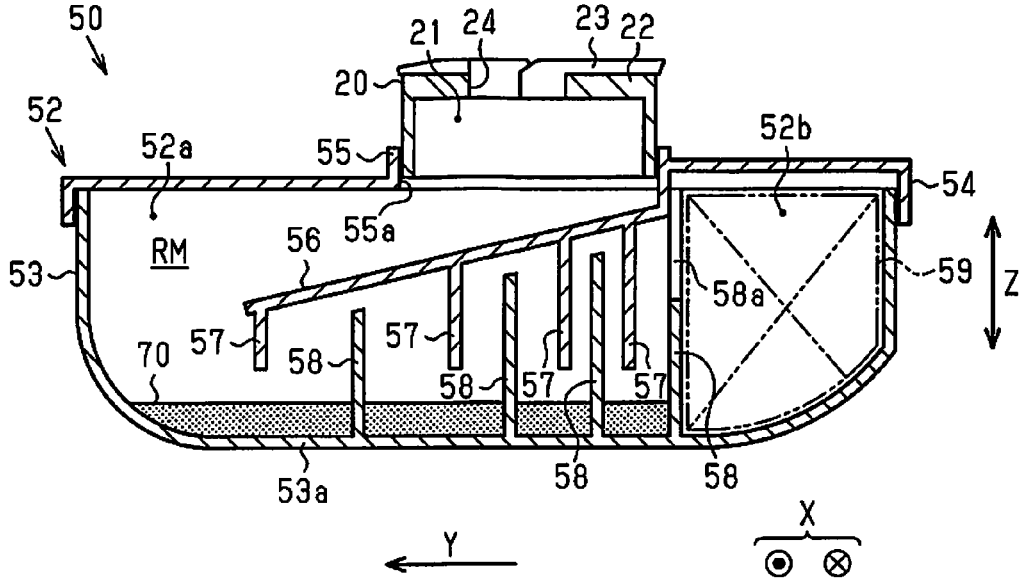
FIG. 15 is a schematic sectional view of a recovery device and a support base of a printing apparatus according to a modification example.

In each of the embodiments, an absorbing material 70 may be disposed on the bottom wall 53*a* of the container main body 53, which is an example of a part constituting the mist flow path RM in the recovery container 52, as illustrated in FIG. 15. Examples of the absorbing material 70 include sponge. It is preferable that the density inside the absorbing material 70 be higher than the density on the surface side of the absorbing material. According to this configuration, the absorbing material 70 facilitates the recovery of the mist in the recovery container 52 upstream of the filter 59 in the flow path RM. In addition, the mist adhering to the surface of the absorbing material 70 is likely to permeate the absorbing material 70 because of a change in the density of the absorbing material 70. Accordingly, ink pool formation in the surface of the absorbing material 70 can be suppressed. The absorbing material 70 may be disposed on a part of the bottom wall 53*a* and may be disposed on at least one of the supporting member 56, the drooping rib 57, and the standing rib 58 that constitute the flow path RM. The absorbing material 70 can also be similarly applied to the recovery device 50 illustrated in FIGS. 13 and 14. The absorbing material 70 disposed on the bottom wall 53*a* is an example of components that face the tip portion (lower end portion) of the vertical wall (drooping rib 82).

In the recovery device 50 according to each of the embodiments and those illustrated in FIGS. 13 to 15, the gap GZ1 in the vertical direction Z between the lower end portions of the drooping ribs 57 and the bottom wall 53*a* of the recovery container 52 may become gradually narrower in the flow path RM as the downstream side closer to the fan 51 is approached.

In the recovery device 50 according to each of the embodiments and those illustrated in FIGS. 13 to 15, the gap GZ2 in the vertical direction Z between the upper end portions of the standing ribs 58 and the supporting member 56 may become gradually narrower in the flow path RM as the downstream side closer to the fan 51 is approached.

Figure 16:
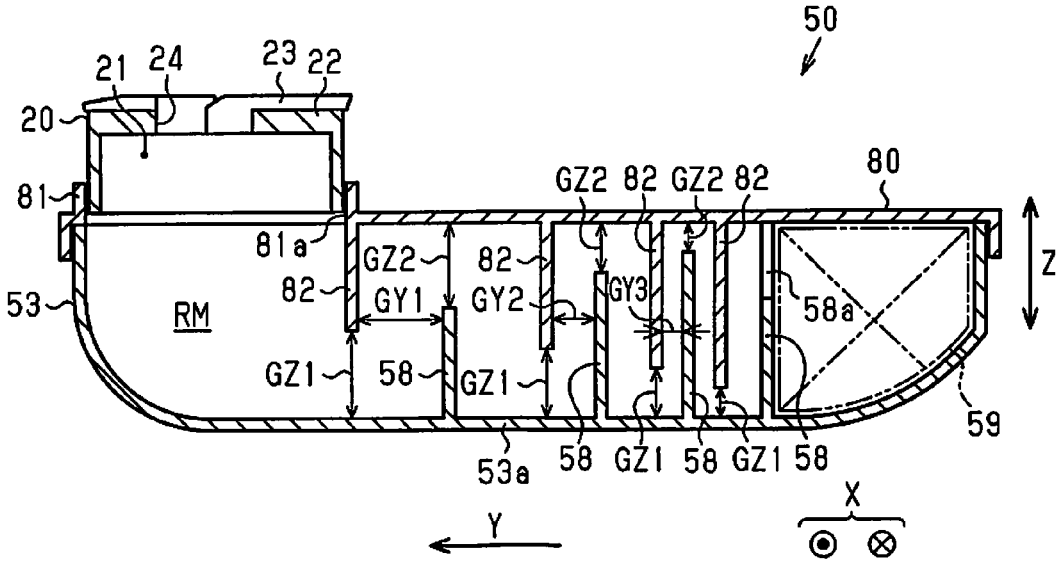
FIG. 16 is a schematic sectional view of a recovery device and a support base of a printing apparatus according to a modification example.
Figure 17:
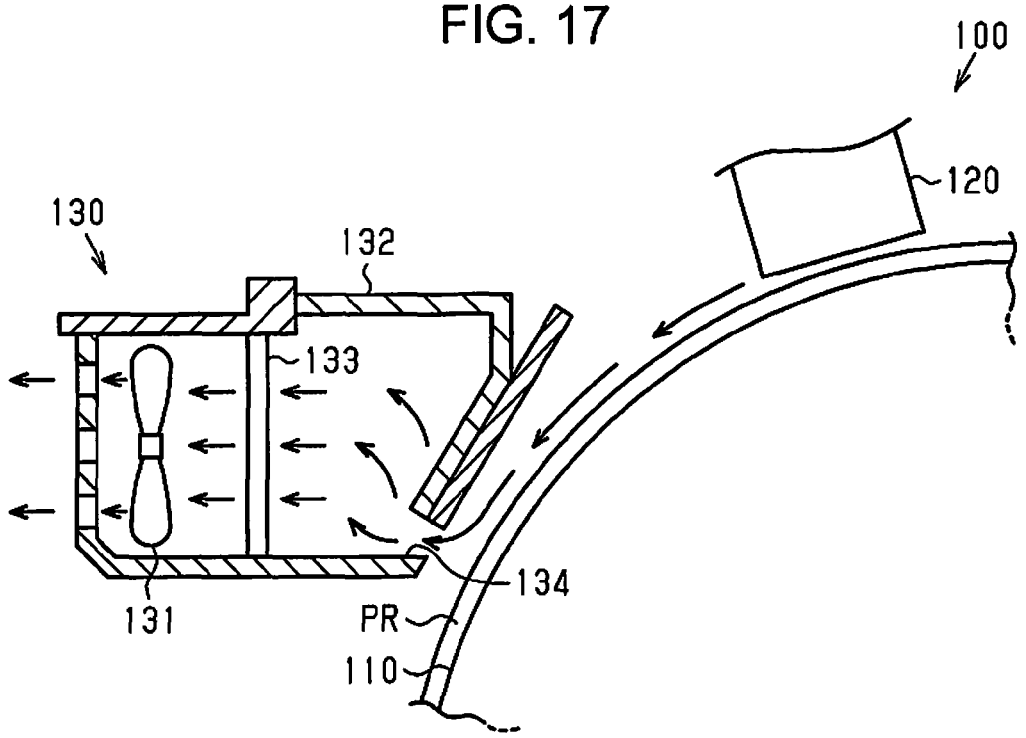
FIG. 17 is a schematic sectional view of a part of a printing apparatus according to the related art.
Figure 18:
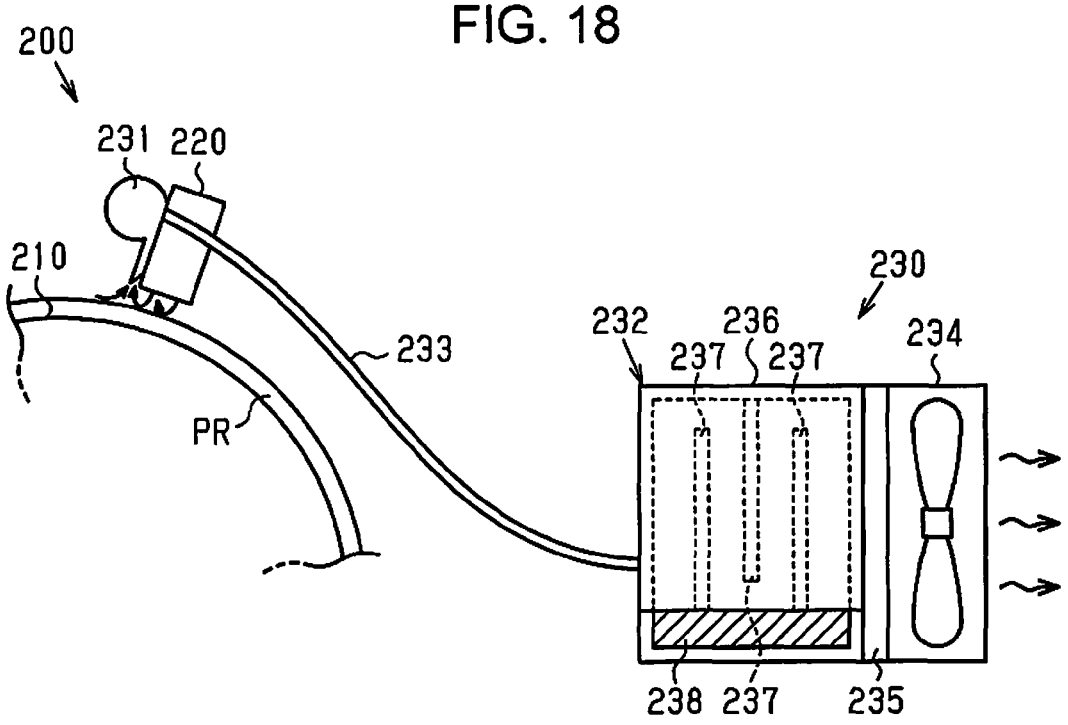
FIG. 18 is a schematic front view of a part of another printing apparatus according to the related art.

The supporting member 56 according to each of the embodiments may be omitted. The configuration of the recovery device 50 that is illustrated in FIG. 16 will be described as an example thereof. The recovery device 50 is provided with a cover 80 instead of the cover 54. An attachment portion 81, where a mist-suctioning suction port 81*a* is formed, is disposed on the downstream side of the cover 80 in the transport direction Y. The support base 20 is attached to the attachment portion 81 for communication between the suction port 81*a* and the internal space 21. A plurality of the drooping ribs 82 are disposed with gaps in the transport direction Y beneath the cover 80 and upstream of the attachment portion 81 in the transport direction Y. The plurality of drooping ribs 82 and the standing ribs 58 are disposed to alternate with each other.

As illustrated in FIG. 16, the gaps GY1 to GY3 between the drooping ribs 82 and the standing ribs 58 that are adjacent to each other to form the mist flow path RM become gradually narrower toward the downstream side in the flow path RM that is closer to the fan 51 (refer to FIG. 6). In addition, the lengths of the drooping ribs 82 in the vertical direction Z increase from the upstream side toward the downstream side of the flow path RM. Accordingly, the gap GZ1 between the lower end portions of the drooping ribs 82 forming the flow path RM and the bottom wall 53*a* of the recovery container 52 facing the lower end portions becomes gradually narrower toward the downstream side in the flow path RM that is closer to the fan 51. Furthermore, the lengths of the standing ribs 58 in the vertical direction Z increase from the upstream side toward the downstream side of the flow path RM. Accordingly, the gap GZ2 between the upper end portions of the standing ribs 58 forming the flow path RM and the cover 80 facing the upper end portions becomes gradually narrower toward the downstream side in the flow path RM that is closer to the fan 51. In an alternative configuration, the gaps GY1 to GY3 may have the same size and the gaps GZ1 and GZ2 may become gradually narrower toward the downstream side in the flow path RM that is closer to the fan 51.

In each of the embodiments, two of the upstream region RM1, the midstream region RM2, and the downstream region RM3 may be combined with each other to constitute the flow path RM. In addition, four or more regions that have different passage cross-sectional areas may constitute the flow path RM. In other words, the number of partitioned regions in the flow path RM is not limited insofar as the flow path RM that is formed by alternating vertical walls such as the drooping ribs 57 and the standing ribs 58 becomes gradually narrower.

In each of the embodiments, the placement and shape of the plurality of nozzle columns 31*b* of the discharge head 31 can be set at will. The placement and shape of the plurality of discarding portions 24 of the support base 20 are changed similarly to the nozzle columns 31*b* along with a change in the placement and shape of the plurality of nozzle columns 31*b*. In other words, the number, placement, and shape of the discarding portions 24 are not limited to the number, placement, and shape of the discarding portions 24 according to each of the embodiments described above insofar as the ink discharged from the discharge head 31 is recovered into the recovery container 52 via the plurality of discarding portions 24 during the flushing by the discharge head 31.

In each of the embodiments, the plurality of ribs 23 of the support base 20 may extend in a direction intersecting with the transport direction Y. For example, the direction in which the rib 23 extends may be parallel to the direction in which the discarding portion 24 extends. In this case, the ribs 23 and the discarding portions 24 may be alternately placed in the width direction X.

In each of the embodiments, the printing apparatus 10 may be provided with a cap moving motor for moving the cap 32 to the discharge head 31 instead of the head moving motor 34 moving the discharge head 31 to the cap 32. In this case, the discharge head 31 is fixedly placed at a position facing the support base 20.

In each of the embodiments, the printing apparatus 10 may also be a multifunction printer without having to be limited to a configuration provided only with a printing function.

The medium is not limited to the sheet P and may be continuous paper, a resin film, a metal foil, a metallic film, a resin-metal composite film (laminate film), a fabric, a nonwoven fabric, a ceramic sheet, and so on.

In each of the embodiments, the printing apparatus 10 is embodied in the form of the ink jet printer. However, the printing apparatus is not limited thereto and may be a liquid discharge device discharging a fluid other than ink (such as a liquid, a liquid body in which functional material particles are dispersed in or mixed with a liquid, and a flowing body such as gel). Examples thereof may include a liquid discharge device discharging a liquid body containing a material such as an electrode material and a color material (pixel material) in the form of dispersion or dissolution and used for liquid crystal display manufacturing, electroluminescence (EL) display manufacturing, surface-emitting display manufacturing, and so on. The examples may also include a liquid discharge device discharging bio-organic matter used for biochip manufacturing and a liquid discharge device discharging a liquid as a sample and used as a precision pipette. The examples may also include a liquid discharge device discharging a lubricant by means of a pin point to precision machinery such as watches and cameras, a liquid discharge device discharging a transparent resin liquid such as a UV curable resin onto a substrate in order to form a micro hemispherical lens (optical lens) or the like used in an optical communication element or the like, and a liquid discharge device discharging an acidic etchant, an alkaline etchant, or the like for etching on a substrate and so on. The examples may also include a liquid discharge device manufacturing 3D models by means of liquid discharge.

The entire disclosure of Japanese Patent Application No.: 2016-000401, filed Jan. 5, 2016 is expressly incorporated by reference herein.

What is claimed is:

1. A printing apparatus comprising:

a printing unit performing printing by discharging a liquid to a transported medium;

a recovery unit recovering mist arising from the liquid discharged from the printing unit; and an airflow generation source moving the mist into the recovery unit, wherein the recovery unit includes a recovery path recovering the mist in an inner portion, wherein the recovery path has walls and ribs disposed on the walls, wherein the walls include a first wall and a second wall placed to face the first wall, wherein the ribs include two first ribs disposed toward the second wall from the first wall and having gaps between the second wall and themselves and one second rib disposed toward the first wall from the second wall and having a gap between the first wall and itself, wherein the second rib is disposed between the two first ribs, wherein the first ribs and the second rib have overlapping parts in a direction intersecting with a direction in which the ribs extend, and wherein a gap between the second rib and one of the two first ribs positioned downstream with respect to a direction in which the mist moves is narrower than a gap between the second rib and the other one of the two first ribs positioned upstream with respect to the direction in which the mist moves.

2. The printing apparatus according to claim 1, wherein the first wall is a plate-shaped member having a first surface on which the rib is disposed and a second surface on a side opposite to the first surface, and wherein the first wall is disposed such that the second surface faces a suction port in the recovery unit suctioning the mist through a gap and is inclined toward an upstream side of the recovery path.

3. The printing apparatus according to claim 1, wherein the recovery unit is connected to a lower part of a support base supporting the medium, wherein a hole communicating with the suction port in the recovery unit suctioning the mist is formed in the support base, wherein the printing unit discharges the liquid toward the support base in a state where a part of the medium is not positioned in the hole during flushing, and wherein driving energy of the airflow generation source during the movement of the mist can be variably controlled.

4. The printing apparatus according to claim 3, wherein the airflow generation source is controlled such that the driving energy of the airflow generation source for recovering the mist after printing termination in a case where a share of the liquid in the medium is equal to or higher than a threshold exceeds the driving energy of the airflow generation source for recovering the mist after printing termination in a case where the share is lower than the threshold.

5. The printing apparatus according to claim 3, wherein the airflow generation source is driven during the flushing and the printing by the printing unit, and wherein the airflow generation source is controlled such that the driving energy at a time when the printing unit performs the flushing in a period following termination of the printing on one surface of the medium and initiation of the printing on the other surface of the medium by the printing unit exceeds the driving energy of the airflow generation source at a time when the printing unit performs the printing on the medium.

6. The printing apparatus according to claim 3, wherein the airflow generation source is driven during the flushing and the printing by the printing unit, wherein the printing unit is provided with a nozzle capable of discharging the liquid and a cap capable of covering the nozzle, and wherein the airflow generation source is controlled such that the driving energy at a time when the printing unit performs the flushing after a predetermined period of time in which the printing unit does not discharge the liquid and the nozzle is not covered by the cap exceeds the driving energy of the airflow generation source at a time when the printing unit performs the printing on the medium.

7. The printing apparatus according to claim 1, wherein the airflow generation source is a fan and the driving energy is a rotation speed of the fan.

8. The printing apparatus according to claim 7, wherein the fan is placed on a downstream side of the recovery path.

9. The printing apparatus according to claim 1, wherein an absorbing material absorbing the mist is disposed in at least a part of a part constituting the recovery path in the recovery unit, and wherein a density inside the absorbing material is higher than a density on a surface side of the absorbing material.

10. A printing apparatus comprising:

a printing unit performing printing by discharging a liquid to a transported medium;

a recovery unit recovering mist arising from the liquid discharged from the printing unit; and an airflow generation source moving the mist into the recovery unit, wherein the recovery unit includes a recovery path recovering the mist in an inner portion, wherein the recovery path has walls and ribs disposed on the walls, wherein the walls include a first wall and a second wall placed to face the first wall, wherein the ribs include one first rib disposed toward the second wall from the first wall and having a gap between the second wall and itself and one second rib disposed toward the first wall from the second wall and having a gap between the first wall and itself, wherein the first rib and the second rib have overlapping parts in a direction intersecting with a direction in which the ribs extend, wherein the first rib is disposed upstream of the second rib with respect to a direction in which the mist moves, and wherein a gap between a tip of the second rib and the first wall is narrower than a gap between a tip of the first rib and the second wall.

11. The printing apparatus according to claim 10, wherein another first rib is disposed downstream of the second rib with respect to the direction in which the mist moves, and wherein a gap between the second rib and one of the two first ribs positioned downstream with respect to the direction in which the mist moves is narrower than a gap between the second rib and the other one of the two first ribs positioned upstream with respect to the direction in which the mist moves.

12. A printing apparatus comprising:

a printing unit performing printing by discharging a liquid to a transported medium;

a recovery unit recovering mist arising from the liquid discharged from the printing unit; and an airflow generation source moving the mist into the recovery unit, wherein the recovery unit includes a recovery path along which the mist is moved by an airflow generated by the airflow generation source, and wherein a speed of the mist movement along the recovery path is higher downstream than upstream with respect to a direction of the mist movement.

* * * * *